US007077919B2

(12) United States Patent
Wood et al.

(10) Patent No.: US 7,077,919 B2
(45) Date of Patent: Jul. 18, 2006

(54) MAGNETIC CORE INSULATION

(75) Inventors: Richard Wood, Blue Jay, CA (US); Richard Lathlaen, San Diego, CA (US); William C. Beckham, Clovis, CA (US)

(73) Assignee: Magnetic Metals Corporation, Camden, NJ (US)

( * ) Notice: Subject to any disclaimer, the term of this patent is extended or adjusted under 35 U.S.C. 154(b) by 231 days.

(21) Appl. No.: 10/455,078

(22) Filed: Jun. 5, 2003

(65) Prior Publication Data

US 2004/0007291 A1 Jan. 15, 2004

Related U.S. Application Data

(60) Division of application No. 09/575,090, filed on May 19, 2000, now abandoned, which is a continuation-in-part of application No. 09/315,549, filed on May 20, 1999, now abandoned.

(60) Provisional application No. 60/141,209, filed on Jun. 25, 1999.

(51) Int. Cl.
*H01F 1/00* (2006.01)

(52) U.S. Cl. ..... 148/122; 148/113; 148/276; 148/284; 148/287; 427/127

(58) Field of Classification Search ..... 148/112, 148/113, 121, 122, 276, 284, 287; 427/127; 29/605, 609

See application file for complete search history.

(56) References Cited

U.S. PATENT DOCUMENTS

| | | | | |
|---|---|---|---|---|
| 2,543,710 | A * | 2/1951 | Schmidt et al. | 148/287 |
| 3,259,526 | A * | 7/1966 | Walker et al. | 148/280 |
| 4,314,594 | A * | 2/1982 | Pfeifer et al. | 148/304 |
| 4,496,401 | A * | 1/1985 | Dawes et al. | 148/217 |
| 4,504,327 | A * | 3/1985 | Inomata et al. | 148/304 |
| 4,596,611 | A * | 6/1986 | Dawes et al. | 148/217 |
| 5,800,635 | A * | 9/1998 | Collins et al. | 148/304 |
| 6,663,728 | B1 * | 12/2003 | Manhardt et al. | 148/430 |

FOREIGN PATENT DOCUMENTS

| | | | | |
|---|---|---|---|---|
| JP | 57-169207 | * | 10/1982 | 148/304 |
| JP | 61-163208 | * | 7/1986 | 148/286 |
| JP | 61-183454 | * | 8/1986 | 148/101 |

OTHER PUBLICATIONS

English translation of Japanese Kokai Patent Application No. Sho 61[1986]-183454 (Sawa et al., Japanese language document cited above).).*

Handbook of Chemistry and Physics, 54th Edition, 1973, p. D-114.*

* cited by examiner

*Primary Examiner*—John P. Sheehan
(74) *Attorney, Agent, or Firm*—Philip O. Post

(57) ABSTRACT

Disclosed herein is an insulating material between adjacent metal layers of a soft magnetic core, and a process for forming this insulating material. The insulating material is composed of the native metal oxides of the metallic core material.

13 Claims, 21 Drawing Sheets

MAGNETIC CORE INSULATION

CROSS REFERENCE TO RELATED APPLICATIONS

This application is a division of U.S. application Ser. No. 09/575,090, filed May 19, 2000, now abandoned, which is a continuation-in-part of application Ser. No. 09/315,549, filed May 20, 1999, now abandoned, and also claims priority to provisional patent application Ser. No. 60/141,209, filed Jun. 25, 1999, the entirety of each of which are incorporated herein by reference.

FIELD OF THE INVENTION

The present invention generally relates to a method of providing insulation between adjacent metal layers of a magnetic core and to soft magnetic cores produced by this method. In particular, the present invention relates to the formation and use of native metal oxides between adjacent metallic magnetic core layers as insulation between the layers to restrict electrical current flow. Advantageously, the method of the present invention can also be used to tailor the magnetic properties of cores formed using the invention.

BACKGROUND OF THE INVENTION

Magnetic materials come in at least two forms, hard or soft. Hard magnetic materials are permanent magnets, which retain their magnetic properties after an energizing field is removed. An example of a hard magnetic material is a common refrigerator magnet. In contrast, soft magnet materials have a magnetic field which collapses after the energizing field is removed. Examples, of soft magnetic materials include electromagnets. Soft magnetic materials are widely used in electric circuits as parts of transformers, inductors, inverters, switch power supplies, and other applications. Soft magnetic materials are also used to make magnetic cores that provide high-energy storage, fast energy storage and efficient energy recovery. In these and other applications, magnetic cores may be used at a variety of different operational frequencies, typically ranging from 50 Hz to 20 kHz or more.

Most magnetic cores are made by winding a very thin magnetic metal strip or ribbon tightly around a substrate to form a multi-layered laminate. The wound metallic core is then subjected to a heating step, known as "annealing," to optimize its performance through heat-induced ordering of the magnetic domains in the metal. After the annealing step, the substrate may be removed and the magnetic core may be treated with binding agents to hold the adjacent metal layers together so that the core will not unwind. As known to those of skill in the art, such binding agents may include epoxies, having either one or two parts, such as Hysol #4242 resin and #3401 hardener (Olean, N.Y.), or #2076 impregnation epoxy by Three Bond Co. Treatment with a binding agent also permits the core to be processed by cutting to form C or E cores, so named because the resulting cut cores resemble a C or an E, as known to those of skill in the art.

The metal strips or ribbon layers making up a magnetic core are very thin, typically from about 0.01 to 0.3 millimeters thick. For high frequency applications of greater than 400 Hz, the individual metal layers of a wound magnetic core must also be electrically insulated from one another for the core to function properly. Without such insulation, at high frequency the magnetic core has electrical properties similar to a large metal block, and will experience large power losses due to eddy currents.

To provide insulation between layers, the prior art generally teaches coating the metal ribbon with an insulating material prior to winding the ribbon to form the core. The insulating material is typically coated on both sides of the ribbon, and functions to insulate the metal layers in the wound laminate from adjacent metal layers. One widely used coating method is described in U.S. Pat. No. 2,796,364 to Suchoff, which discloses a method of forming a layer of magnesium oxide on a metal ribbon surface as an insulating layer. As described in Suchoff, magnesium methylate is dissolved in an organic solvent, and the solution is applied to the metal ribbon surface. The metal ribbon is then heated to high temperature to form a strongly adherent magnesium oxide insulating film over the surface of the metal ribbon. The metal ribbon may then be wound to form the magnetic core.

There are several known disadvantages to the magnesium methylate process. First, the magnesium methylate must be applied to the metal ribbon before it may be wound into a core. Uncoiling the metal ribbon, dipping the ribbon into a bath to form the coat, heating and curing the coat, and winding the ribbon to form the core make the process slow and expensive. The magnesium methylate process is therefore not suitable to provide insulation to magnetic cores in low cost, high volume applications. Second, it is very difficult to control the thickness of the resulting magnesium oxide insulating layer. This presents a problem for certain magnetic core applications, such as pulse cores, which have high performance specifications that are difficult to achieve unless the coated magnesium methylate layer is very thin. Forming thin magnesium methylate coatings requires special processing that is very slow and difficult to control. Use of the magnesium methylate process for these applications is extremely expensive, and the resulting cores are fragile. Furthermore, even for applications where a thicker insulating layer is acceptable, valuable magnetic core space is taken up when excessive nonconductive insulating material is present. This reduces the space factor of the laminated stack so that the percentage of the core occupied by magnetic material is lessened along with the efficiency of the core. Finally, because the magnesium methylate must be coated before the annealing step, it may also interfere with the ordering of magnetic domains during annealing by inducing stress buildup between the coating and the soft magnetic material.

The magnesium methylate process also cannot be used to form insulating layers for certain types of magnetic cores. High temperatures are required to properly cure the magnesium methylate on the metal ribbon. Typically, the magnesium methylate coating must be heated to temperatures of at least 843° C. (1550° F.) or more to form a magnesium oxide film which firmly adheres to the metal ribbon. However, some soft magnetic materials, such as amorphous metal alloys, may not be heated to temperatures greater than about 449° C. (840° F.) without destroying their desirable magnetic properties. When magnesium methylate is used as an insulating material for these types of metal alloys, it is heated to much lower temperatures, and the resulting magnesium oxide layer is only loosely bound to the metal ribbon. As a result, these types of cores may not be cut to form C or E cores, because the stressful cutting operation will cause the loosely bound insulating coatings to delaminate. Only uncut cores such as toroids can be formed from amorphous metal alloys coated with the magnesium methylate process. Moreover, the present inventors know of only one other process which may be used to form C or E magnetic cores of amorphous metal alloys. That process involves forming a thin discontinuous magnesium oxide coating on the ribbon prior to winding, and because the coating is not continuous, results in cores having high power dissipation at high frequency.

Thus, there is a need for improved methods of forming thin dielectric insulation on soft magnetic metal ribbons used to make magnetic cores. There is also a need for an insulation which permits processing of amorphous metal cores to form C and E cores that can be used at high frequencies.

SUMMARY OF THE INVENTION

The present invention advantageously overcomes the shortcomings of the prior art by providing a process to form insulating layers between adjacent metal layers of a magnetic core after the core has been wound. The process may be used to provide insulation to a wide variety of metals and metal alloys used to make magnetic cores, including amorphous metal alloys. The insulating material formed by the process of the present invention is firmly bound to the surface of the metal ribbon forming the core, and cores incorporating the insulating material may be cut to form C or E cores, or other cut cores known to those of skill in the art. Consequently, for the first time, C and E cores can be made which are formed of amorphous metal alloys which are protected by continuous insulating films and suitable for high frequency applications.

In one aspect of the present invention, there is a method of providing dielectric isolation between adjacent metal layers of a laminated magnetic assembly. The method comprises a first step of oxidizing a laminated magnetic assembly, where the assembly is a plurality of layers which are formed in part of iron. The oxidation produces a coating comprising a mixture of iron oxides. The resulting magnetic assembly has a resistivity of greater than about 500 ohm-cm. The oxidizing step may comprise exposing the plurality of layers to steam in the presence of oxygen at a temperature of at least 260° C. (500° F.). Preferably, the layers may be heated to a temperature of from about 260° C. to 427° C. (500° F. to 800° F.). When the layers are an amorphous metal alloy, it is preferred that the layers are heated to between about 354° C. to 427° C. (670° F. to 800° F.) and where square loop cores are desired, preferably from about 354° C. to about 379° C. (670° F. to 715° F.). In preferred embodiments of the method, the oxidized laminated magnetic assembly exhibits at least a 15% decrease is power loss at operational frequencies of 10 to 20 kHz in comparison to the magnetic assembly prior to exposure to steam and air.

In another aspect of the present invention, there is a method of making a dielectrically insulated soft magnetic assembly. The method comprises a first step of winding an amorphous metal alloy ribbon containing iron into a multilayered core. Then, the core is heated in the presence of water and oxygen to oxidize the iron of amorphous metal alloy ribbon to form a coating comprising oxides of iron. The coating is at least about 0.03 microns thick.

In another aspect of the present invention, there is provided a soft magnetic assembly comprising an elongate amorphous metal strip. The strip is at least about 40% iron. The strip has a first side and a second side. The first side has small protrusions and the second side is substantially smooth. The strip is wound to form a laminate such that the protrusions on the first side contact the smooth second surface. A coating comprising oxides of iron substantially covers the smooth second surface and at least a portion of the protrusions which contact the smooth second surface. The coating preferably has a thickness of 0.03 microns or more. In some embodiments, greater than 75% of the coating comprises iron (III) oxide and iron (IV) oxide (i.e., $Fe_2O_3$—FeO, also known as magnetite and iron (II–III) oxide). It is also preferred that the coated soft magnetic assembly have a resistivity of greater than 500 ohm-cm, more preferably greater than 1000 ohm-cm, and most preferably greater than 10000 ohm-cm.

In another aspect of the present invention, there is provided a dielectric insulating coating between contact points of adjacent metal layers of a soft magnetic assembly. The coating comprising primarily iron (III) oxide in sufficient amount to reduce power losses in the assembly by at least 15%. Preferably, the dielectric insulating coating is present in sufficient amount to reduce power losses in the assembly by at least 30%, and more preferably by at least 45%.

In another aspect of the present invention, there is provided a soft magnetic assembly with an insulative coating material between adjacent metal layers of the assembly, the coating consisting essentially of oxides of iron, the assembly having a resistivity of at least 1000 ohm-cm.

In another aspect of the present invention, there is a method of forming an insulative coating on the surface of an amorphous metal alloy strip. The method comprises providing an amorphous metal alloy strip in which the percentage of iron exceeds the percentage of any other element present in the alloy. Then, the strip is heated to a temperature at which the alloy anneals. The strip is then exposed to steam in the presence of oxygen to form a coating of oxides of iron over a substantial portion of the strip. Optionally, the strip may be wound into a core prior to heating the strip to the annealing temperature.

In another aspect of the present invention, there is provided a magnetic C core. The core has a plurality of amorphous metal alloy strips forming a laminate which are semicircular, semi-oval or semi-rectangular in shape. A metal oxide insulating coating is between adjacent strips within the laminate. The oxide is formed from the oxidation of iron. The insulative coating reduces power losses in the core by at least 15% when the core is used at operational frequencies of 10 kHz or more.

DETAILED DESCRIPTION OF THE PREFERRED EMBODIMENT

The present invention generally relates to native metal oxide insulating compositions which may be formed on magnetic cores after the cores have been wound. Although described below in the context of a wound toroidal magnetic core, it should be readily appreciated by those of skill in the art that the teachings of the present invention can be applied to magnetic cores having a variety of shapes and dimensions. For example, the present invention may be readily applied as part of a process to form C magnetic cores, E magnetic cores, and other laminated magnetic assemblies known to those of skill in the art. Furthermore, the invention can be applied to magnetic assemblies which comprise laminates which have not been wound, as for example, forming a magnetic laminate assembly by stacking successive layers.

Figure 1:
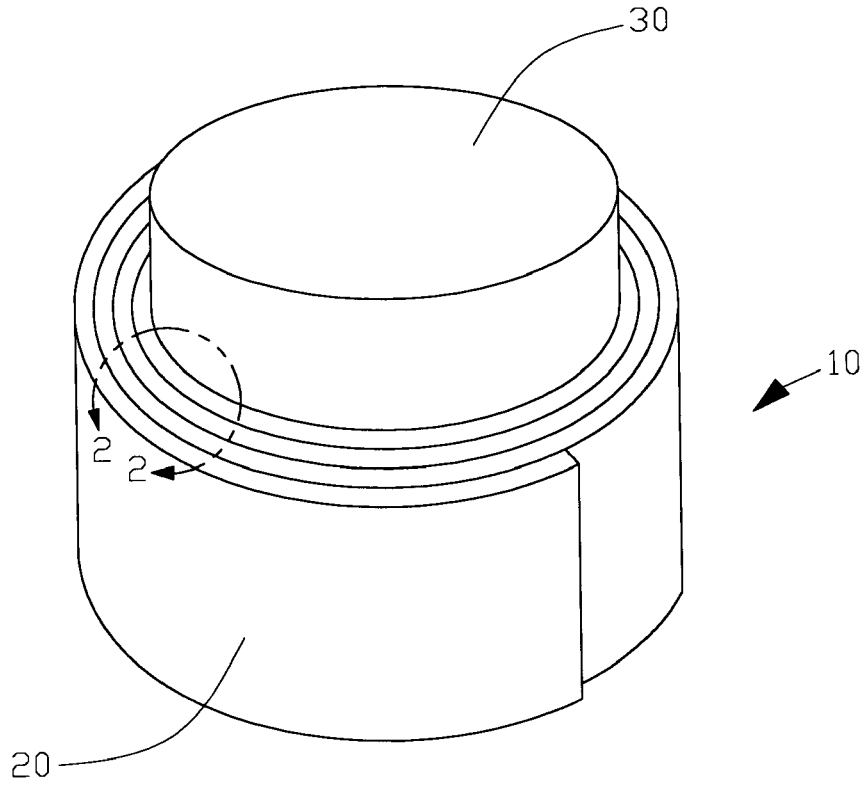
FIG. 1 is a schematic perspective view of a toroidal magnetic core.

Referring to FIG. 1, there is depicted a schematic of a wound toroidal magnetic core 10 incorporating the present invention. Magnetic core 10 is formed by winding a thin metal strip or ribbon 20 around a mandrel 30 to form a laminate. Mandrel 30 is merely a hard solid substrate around which the ribbon is wound, such as an elongated metal bar or rod. Mandrel 30 is removed in subsequent core processing, and is not part of the final magnetic core 10. Mandrel 30 may have various sizes and shapes such as round, rectangular, square, etc., which can be selected to form cores having differing shapes and dimensions. Metal ribbon 20 is wrapped around mandrel 30 a sufficient number of turns to form a multi-layered laminate of the desired aggregate thickness. For purposes of the present invention, ribbon 20 may be wound to form cores similar in size, dimension and weight to those now commercially available. After winding is complete, the wound core 10 may be annealed to optimize its performance, as known to those of skill in the art.

Figure 2:
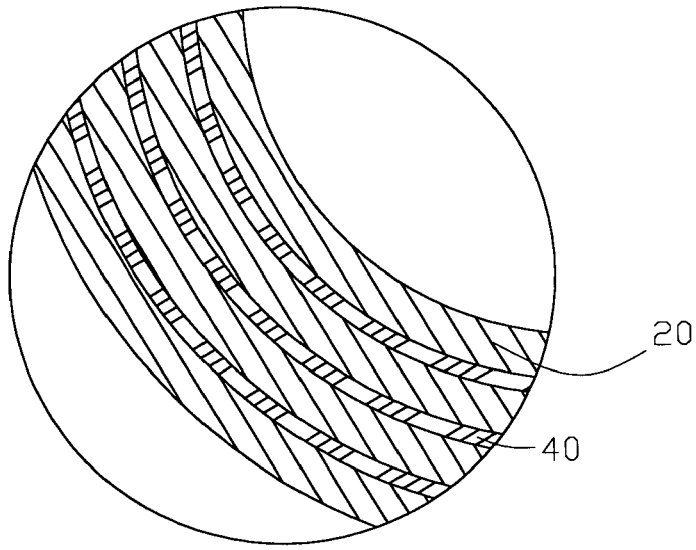
FIG. 2 is a schematic cross sectional view of the magnetic core of FIG. 1.

Metal ribbon 20 is a soft magnetic metal or alloy having iron as the dominant metal. Metal ribbon 20 is preferably thin, and may range from about 0.01 millimeters to 0.3 millimeters in thickness. Metal ribbon 20 may also vary in width from about 0.1 cm to about 25 cm. To minimize power losses at high frequencies, an insulating material 40 is provided between adjacent layers of metal ribbon 20. As shown schematically in FIG. 2, core 10 has a coating of insulating material 40 between layers of metal ribbon 20. Insulating material 40 is formed at least on some of those portions of the layers of metal ribbon 20 which contact adjacent metal layers, and therefore restricts electrical current flow between adjacent metal layers. In some embodiments, metal ribbon 20 may be an amorphous metal alloy, preferably iron based transition metal based metalloids, having the formula TM-M, where TM is at least 80% Fe, Co or Ni, or mixtures thereof, with the remaining 20% comprising M, where M is selected from the group comprising B, C, Si, P or Al, or mixtures thereof. In other embodiments, metal ribbon 20 may be a nanocrystalling material.

Advantageously, the present invention provides a unique process which can be used to form insulating material 40 between adjacent metal layers of ribbon 20 after ribbon 20 has been wound into core 10. Thus, the time consuming and expensive coating processes of the prior art may be avoided. Furthermore, the unique insulating material 40 of the present invention is thin and is firmly adhered to ribbon 20. Thus, when insulating material 40 is formed on a magnetic core made of an amorphous metal alloy, the core may be cut to form soft magnetic assemblies previously unavailable, such as C and E cores of amorphous metal alloys.

Generally, insulating material 40 is formed by oxidizing metal ribbon 20 to form native metal oxides of the metals or alloy metals as a very thin coat overlying the surface of metal ribbon 20. The native metal oxides of most metals used to form cores have relatively high resistivities and are particularly suited to function as insulation between adjacent metal layers. Because most metals and metals in alloys which may form ribbon 20 may be oxidized to form a metal oxide having sufficient electrical resistance to form an adequate insulating material 40, the present invention is widely applicable to soft magnetic core materials used today. Table 1 sets forth representative examples of metals and metal alloys which may be used in the present invention, and the corresponding chemical composition of some of the insulating materials which may be created by oxidation of the metals or alloys.

TABLE 1

Partial listing of soft magnetic metals

| Elemental Metals | Approximate Alloy Composition | Trade Name | Native Metal Oxide Insulating Materials |
|---|---|---|---|
| Fe, Ni | 40% Fe, 38% Ni, 18% B, 4% Mo | METGLAS ® Alloy 2826MB | FeO, $Fe_2O_3$, $Fe_3O_4$ |
| Fe, B | 81% Fe, 13.5% B, 3% Si, 2% C | METGLAS ® Alloy 2605SC | FeO, $Fe_2O_3$, $Fe_3O_4$ |

TABLE 1-continued

Partial listing of soft magnetic metals

| Elemental Metals | Approximate Alloy Composition | Trade Name | Native Metal Oxide Insulating Materials |
|---|---|---|---|
| Fe, Co, Ni | T (70–80%), M (30–20%) | Amorphous and Nanocrystalline | FeO, $Fe_2O_3$, $Fe_3O_4$ |
| Fe, B | 70% Fe, 9% B, 3% Nb, 2% Cu, Mo, Co, Si | Nanocrystalline | FeO, $Fe_2O_3$, $Fe_3O_4$ |
| Fe, Co | 67% Fe, 18% Co, 14% B, 1% Si | METGLAS ® Alloy 2605CO | FeO, $Fe_2O_3$, $Fe_3O_4$ |
| Fe, Co | 49% Fe, 49% Co, 2% V | SUPERMENDUR ® | FeO, $Fe_2O_3$, $Fe_3O_4$ |

Where T = Fe, Co, Ni and M = B, C, Si, P, Al in the table.

Where iron is the dominant metal in the alloy, as for example in METGLAS® Alloy 2605SA1, the insulative material is formed primarily of iron (III) oxide ($Fe_2O_3$), with the remainder being mostly iron (II–III) oxide. For example, for one core treated with steam and air at 690° F. for 6 hours, Raman spectroscopy revealed that the insulating layer was composed of approximately about 80% to 90% $Fe_2O_3$ and 10% to 15% $Fe_3O_4$ (i.e., iron (II–III) oxide) with small amounts of FeO. The layer had a thickness of 0.15 microns of this iron oxide mixture.

It should be appreciated by those of skill in the art that the representative alloys and metals set forth above are meant as illustrative examples, and the teachings of the present invention are applicable to iron dominant alloy compositions other than those described above. For example, the present invention can easily be applied to alloys which merely alter the compositional percentages, or alloys which introduce new metals or elements without affecting the ability of the iron-dominant alloy to be oxidized to form insulating iron oxides.

Insulating material 40 should be formed thick enough and have sufficient resistance to effectively insulate successive layers of metal ribbon 20 from electrical current flow between the layers. If the insulating metal 40 is formed too thick, however, the resulting magnetic core 10 will contain excessive nonconductive insulating material, and the magnetic core 10 will have a low space factor, i.e., the percentage of the magnetic core 10 occupied by magnetic material is low, reducing the efficiency of the core. Preferably, insulating material 40 is formed to have a thickness of between 0.01 and 5 microns, more preferably between 0.03 and 2 microns, and optimally between 0.03 microns and 0.5 microns. Of course, as should be appreciated by those of skill in the art, other thicknesses of insulating material 40 may be provided by varying the processing conditions described below. For example, where insulating material 40 is formed primarily of a metal oxide having a relatively high resistivity, thinner layers may be used to increase the space factor and core efficiency. Furthermore, for some applications, greater amounts of insulating material 40 may be desired between adjacent metal layers, such as for very high frequency and pulse power applications. Preferably, the insulating layer 40 is thin enough so that the resulting core has a space factor of at least 70%, more preferably 80%, and optimally 85% or more.

The electrical resistance of the laminate incorporating the present invention is a function of the resistivity of the metal oxide multiplied by the form factor of insulating material 40, combined with the marginal resistance created by the metal material of core 10. For most applications, it is preferred that core 10 have an effective resistivity of a 500 Ω-cm and more preferably at least 1000 Ω-cm and optimally at least 10000 Ω-cm. Of course, as should be appreciated by those of skill in the art, the present invention can easily be adapted to create insulating material 40 having laminate resistivities greater or less than the described values, by varying the processing conditions described below. Magnetic laminates formed using the present invention can support from at least about 2 to 10 volts per layer of lamination.

In general terms, insulating material 40 is formed by controlled oxidation of the iron in metal ribbon 20. The presently preferred method of oxidation is to expose magnetic core 10 to steam in the presence of air (approximately 20% $O_2$) at elevated temperatures. The steam and air diffuse into wound core 10 and contact the surfaces of the heated layers of ribbon 20, resulting in accelerated oxidation of the surface of metal ribbon 20 to form a thin metal oxide coat or layer on the surface of metal ribbon 20. The steam and heat accelerate the electron transfer rate during some or all of the reactions from the metals of the ribbon alloy to oxygen, to form the iron oxides. The processing conditions can also be varied to further accelerate the electron transfer rate during some or all of the reactions, such as introducing various catalysts, as described more fully below, or temperature increases to decrease steam particle size.

Furthermore, as will be appreciated by those of skill in the art, different processing conditions which accelerate electron transfers between the metals and oxygen to form native metal oxides may be substituted for or supplement the steam/air combination. These alternate processing conditions may include exposing the laminated assembly to high concentrations of highly reactive oxidizing molecules such as ozone, nitrous oxide, and other highly reactive oxides of nitrogen. It is expected that if these highly reactive molecules are introduced in controlled manner in conjunction with the process described herein, reaction rates will be accelerated to form the insulating metal oxides.

Furthermore, for some applications, it may be desirable to form metal sulfides as the insulating material. To achieve this, hydrogen sulfide ($H_2S$) may be substituted for water in steam, to form native metal sulfides as the insulating layer of the present invention. Other analogues to oxygen and sulfur, such as selenium, might also be used as electron acceptors to form insulating compounds between adjacent metal layers.

Figure 3:
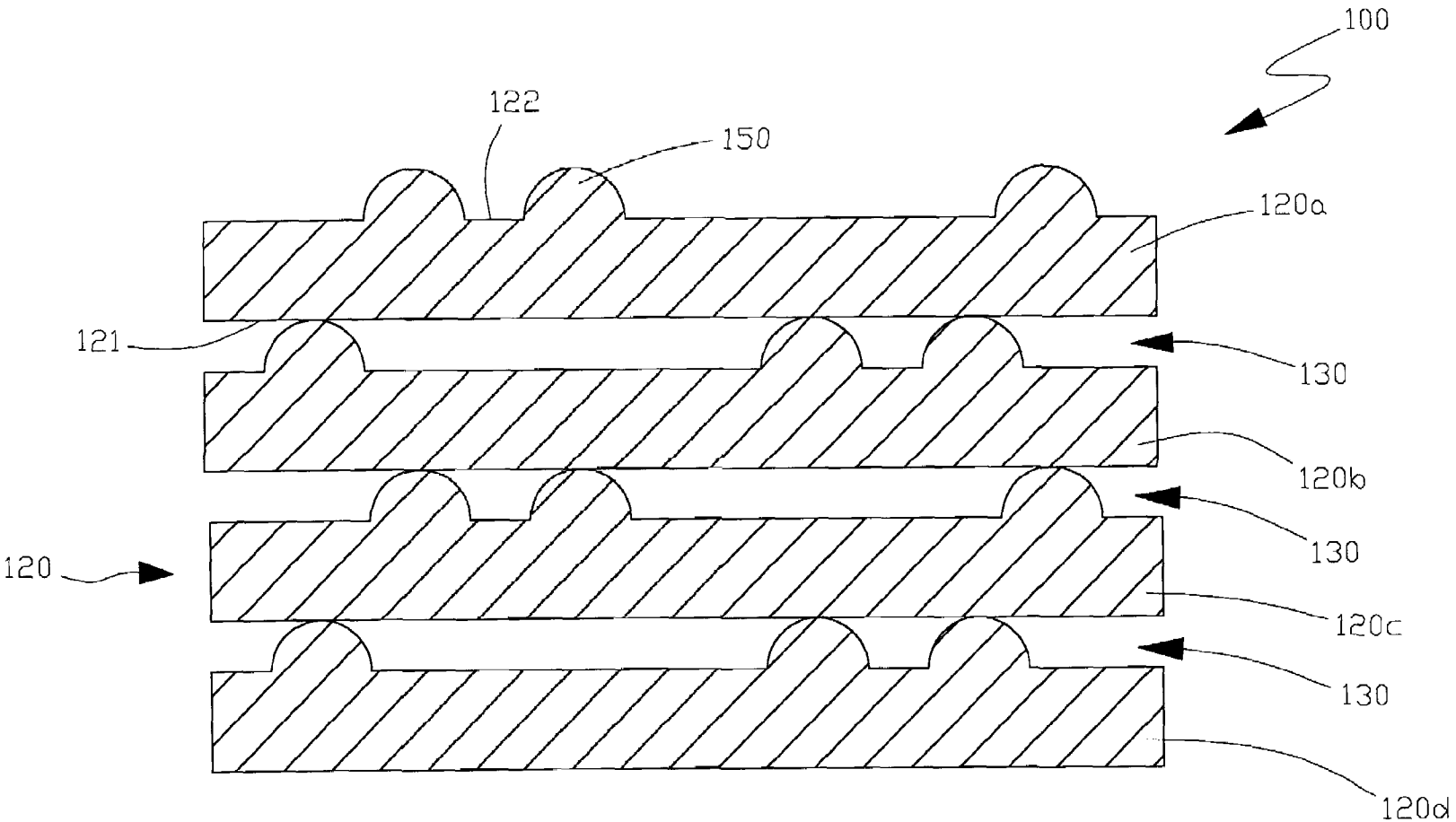
FIG. 3 is a schematic cross sectional diagram of an amorphous metal strip which has been wound to form a laminate, prior to formation of the insulating material of the present invention.

As can be readily appreciated, changes in the processing conditions or materials which facilitate complete and fast penetration of steam and air between all layers of heated laminated assembly such as core 10 will result in faster processing times and more uniform coats or layers of insulating material 40 on ribbon 20. The present inventors have found that the surface morphology of ribbon 20 can be selected to optimize diffusion or penetration of steam and air between layers. Referring to FIG. 3, there is shown a magnified view of a cross sectional portion of a wound core 100 formed of a soft magnetic material. Core 100 may be formed of any of the metals or alloys disclosed in Table 1, above, and variations thereof. Core 100 has multiple layers of metal ribbon 120, four of which, 120*a* through 120*d*, are depicted in FIG. 3. The adjacent metal layers 120*a* through 120*d* are not provided with an insulating material between them, and therefore readily conduct electric current flow at their points of contact. As shown in FIG. 3, ribbon 120 has a relatively smooth surface 121 and a rougher surface 122. Rougher surface 122 is characterized by protrusions or pips 150, which rise from the surface by a small distance in comparison to the thickness of layers 120*a* through 120*d* at scattered points on the surface of the metal ribbon 120. When ribbon 120 is wound to form a laminate, as depicted in FIG. 3, pips 150 contact the smooth surface 121 and thereby establish an electrical current flow path between adjacent metal layers 120*a* through 120*d*. A very small gap 130 is created between adjacent metal layers, defined approximately by the distance pips 150 rise from the surface. Advantageously, gap 130 provides a path which facilitates penetration of steam and air into the interior of wound core 100 during the process of the present invention.

Metal ribbons having the gaps and pips described above are commercially available as, for example, the amorphous metal alloys sold by Honeywell (formerly sold by Allied Signal Corporation) under the trade name METGLAS®. For the METGLAS® ribbons, the differing surface morphologies of metal ribbon 120 are an artifact of the processing conditions used to create metal ribbon 120. The METGLAS® ribbons are formed by spraying molten metal alloys onto the surface of a rotating drum cooled with liquid chilling. The molten metal is cooled at a rate of about 100000 degrees centigrade per second or faster. The alloys solidify before the atoms have a chance to segregate or crystallize. The resulting solid metal alloy has an amorphous glass-like atomic structure. The surface of the solid ribbon which contacted the drum is rougher because the rough drum surface introduces minor imperfections, which create pips 150.

Figure 4:
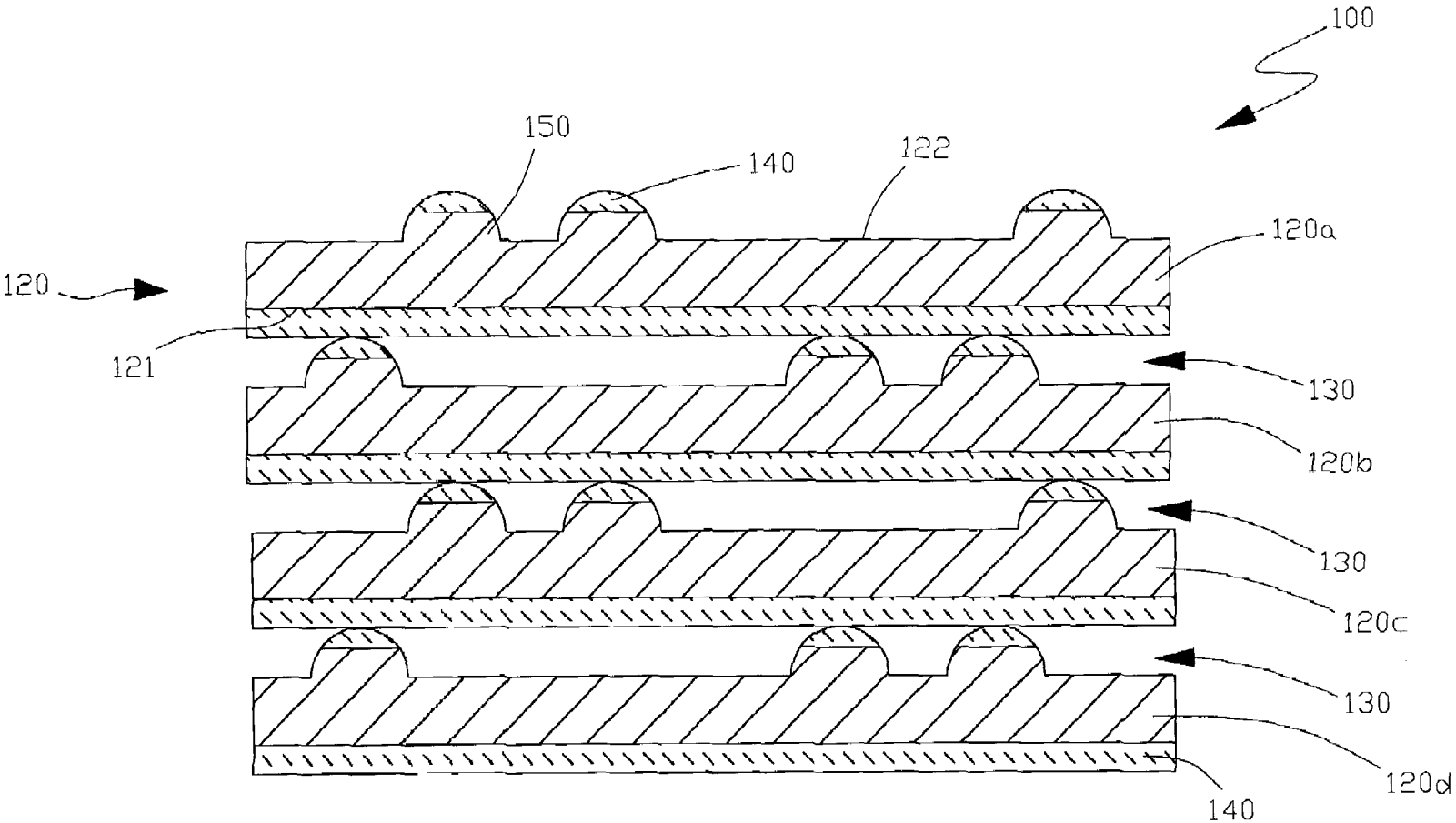
FIG. 4 is a schematic cross sectional diagram of an amorphous metal laminate of FIG. 3 featuring the metal oxide insulating material of the present invention.

Referring to FIG. 4, there is shown a schematic cross sectional diagram of the laminate of FIG. 3 which has been provided with insulating material 140 of the present invention. As shown in FIG. 4, a metal oxide material comprising insulating material 140 has been formed between adjacent layers 120*a* through 120*d*. Insulating material 140 is formed both on the relatively smooth surface 121 and on the rougher surface 122, and particularly covers pips 150. Insulating material 140 is positioned between metal contact points of adjacent metal layers 120*a* through 120*d*, and the electrical current paths previously present are substantially disrupted. As a result, the laminate is much more resistive to electrical current flow.

The presently preferred processing conditions to oxidize the metal to form the metal oxide insulating material are dependent on the core metals, and also on the desired magnetic properties. For example, when an amorphous metal alloy of Fe/Si/C/B is being processed, it is preferred to heat the magnetic core to a temperature of from about 260° C. to 427° C. (500° F. to 800° F.). Where amorphous metal cores having square loop properties are desired, heating is preferably between about 354° C. to 379° C. (670° F. to 715° F.), more preferably 354° C. to 365° C. (670° F. to 690° F.), in combination with application of application of a longitudinal magnetic field. Where flat loop properties are desired, heating is preferably at a temperature greater than about 399° C. (750° F.) up to about 416° C. (780° F.). Where round loop properties are preferred, heating is preferably at a temperature between about 377° C. and 388° C. (710° F. to 730° F.).

For amorphous metal alloys, good results have been achieved by heating the core to its annealing temperature, and simultaneously forming the metal oxide coating while annealing. For most amorphous metal alloys, the annealing temperature is between 354° C. to 365° C. (670° F. to 690° F.), although several such alloys may have annealing temperatures outside of this range. The annealing conditions for the metal ribbon alloys used to make magnetic cores are well known to those of skill in the art. For example, the annealing conditions for amorphous metal alloys sold under the trademark METGLAS® are reported in Allied Signal's and Honeywell's Advanced Materials Technical Bulletins.

It has been observed that the process of forming the insulating material is more efficient if the wound magnetic core is treated in a circulating oven. One oven suitable for this treatment is made by Blue M of Blue Island, Ill., and sold as model AGC7-1406G. Circulation of the air/steam mixture in the oven is believed to keep the temperature equal throughout the oven, and to bring air into the oven which contributes to the oxidation reaction. After the process is completed, the oven is cooled.

The core should be exposed to steam for a period of time sufficient to form an adequate layer of insulating material 40 for the intended core application. It has been observed that time periods of from 0.5 to 12 hours or longer may be used. Good results have been observed when the exposure time is 1 to 6 hours, more preferably 2 to 6 hours, and optimally 4 to 6 hours. The steam pressure should be sufficient to cause good penetration of the steam into the laminate assemblies. It has been found that steam pressures of about 0.1 to 2.5 psi, more preferably 1 to 2 psi, are sufficient for this purpose. However, other steam pressures may be used, as will be readily appreciated by those of skill in the art. For example, it is contemplated that steam pressures ranging from 0.1 to 100 psi or more may be used. Moreover, the flow of steam introduced in the oven must be sufficient to permit the coating to form. Preferably, the flow is at least 0.22 gal/hour per cubic foot of oven space, more preferably at least 0.25 gal/hour per cubic foot, and optimally at least 0.26 gal/hour per cubic foot. Flow restrictors which may be used to control the flow of steam into the oven include circular hole plugs having diameters ranging from 1/16 inch to 5/8 inch.

Enhanced growth and thickness of the coating on the metal ribbon is observed when the steam is infused with $[Fe^xO_y]^{+z}$ cations, where x, y, z factors in this chemical formula are: $1 \leqq x \leqq 2$, $1 \leqq y \leqq 3$, $1 \leqq z \leqq 3$. The ferric part of the $[Fe_xO_y]^{+z}$ cation is believed very active in facilitating oxidation on the mostly iron surface of METGLAS® 2605SA1 and other iron rich amorphous alloys and other metals that may be used in the invention. The ferric cations initiate the necessary electrochemical reactions due to oxidizing state considerations, and couple easily to steam with ionic bonding. It is also possible that some of the $Fe_2O_3$ dissolved in the steam is entrained in the growing iron oxide on the surface of the coated metal, thereby augmenting its thickness and insulative properties.

Suitable sources of ferric cations may be as simple as ferric oxide residues in an iron boiler used to generate the steam. A more preferred source is to pack the $[Fe_xO_y]^{+z}$ cations into a transference matrix having a known concentration of ferric cations, which is placed into the path of the steam. Use of such a transfer matrix improves consistency in the coating process, resulting in cores which are more uniform in magnetic performance for both amorphous metal alloys and nanocrystalline materials. It is preferred that the matrix onto which $Fe_2O_3$ (the source of the $[Fe_xO_y]^{+z}$ cation) is packaged, i.e., adsorbed, has a very high surface area as well as surface properties which facilitate the release of $[Fe^xO_y]^{+z}$ cation and possibly $Fe_2O_3$ molecules into steam. The matrix should have a high surface area, distributed in a multi-modal pore distribution, combined with strong desorption properties. The present inventors have found that a suitable matrix may be formed by soaking aluminum silicate in a dilute ferric chloride solution (that has been clairified with HCl), and then reducing the mixture with $NH_4OH$ and heat to adsorb the ferric oxide which is produced. A matrix having 10% w/w of iron should supply sufficient ferric oxide cations. Such a matrix is manufactured commercially by Amorphico, Hesperia California. The reduction in power loss for magnetic cores made from the present inventive process using a ferric aluminum silicate matrix was typically no less than 30%, ranging up to 50% for METGLAS® 2606SA1 in comparison to cores not exposed to ferric oxide cations from an aluminum silicate matrix, and had improved consistency compared to performance from boiler chips or hard water.

Figure 7:
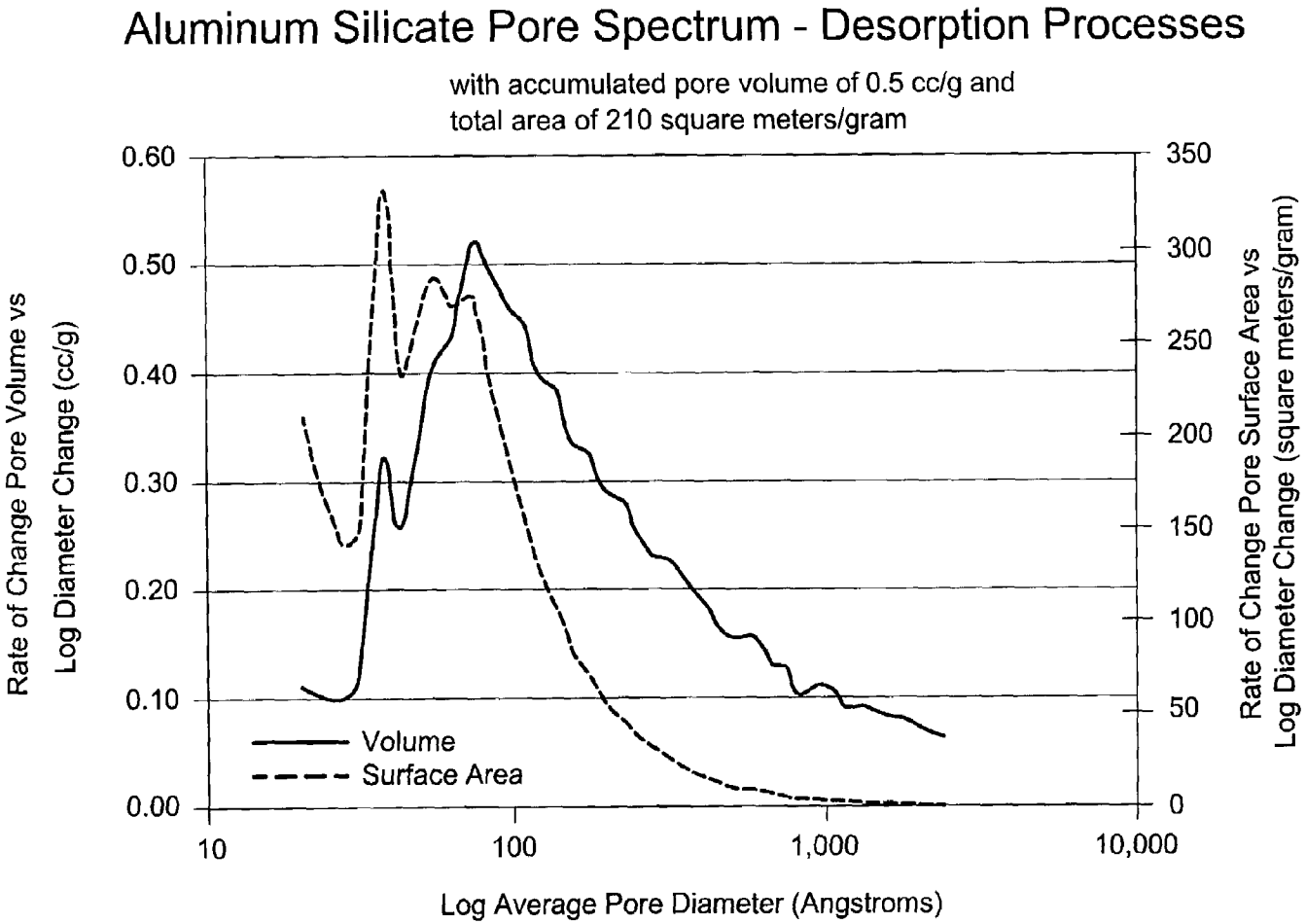
FIG. 7 is a plot of a pore spectrum for an aluminum silicate matrix suitable for providing a transference matrix for ferric oxide.
Figure 8:
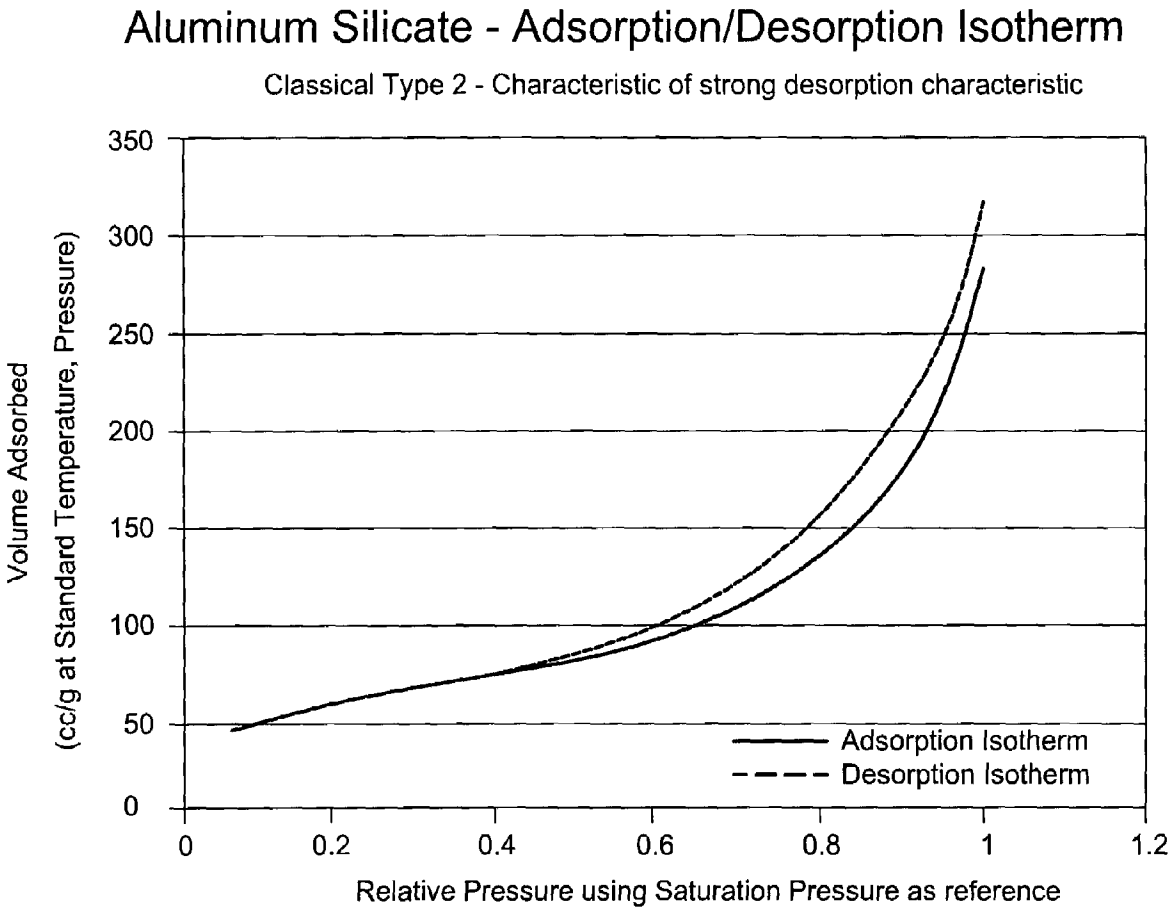
FIG. 8 is an adsorption/desorption isotherm for an aluminum silicate matrix suitable for providing a transference matrix for ferric oxide.

Referring to FIG. 7 and FIG. 8, there is shown the pore spectrum and adsorption/desorption isotherms of a suitable aluminum silicate that may be used as the matrix for $Fe_2O_3$. FIG. 7 portrays a material with both a high internal pore surface area (over 200 meters$^2$ per gram) and a broad pore size distribution from 20 to 1000 angstroms. FIG. 8 portrays a nearly ideal isotherm for slow release of the $[Fe_xO_y]^{+z}$ cations into impinging steam over practical time intervals for many successive batch coating runs. In short, the aluminum silicate makes an acceptable time release matrix for the $[Fe_xO_y]^{+z}$ cations.

The aluminum silicate, characterized by FIG. 7 and FIG. 8, shows that the combination of high surface area and close to ideal desorption properties creates a matrix which releases effective concentrations of $[Fe_xO_y]^{+z}$ cations and $Fe_2O_3$ molecules into a low pressure steam source. The "doped" steam in turn transports the $[Fe_xO_y]^{+z}$ cations and $Fe_2O_3$ molecules between the laminations of impinging strip cores. The deposited $Fe_2O_3$ and ferric ion cations enhance the oxidation of iron in the metal alloys, thereby resulting in effective insulative coatings. Approximately 20 $in^3$ of the ferric aluminum silicate matrix has a useful life of at least 20 to 40 four hour production runs, i.e., 4 to 8 hours per cubic inch of ferric aluminum silicate matrix. The matrix may supply 150 to 200 ppm feric oxide/ferric oxide cations to the steam entering the chamber and produce acceptable coatings.

The performance data of cores formed using a ferric aluminum silicate matrix of the type characterized in FIG. 7 and FIG. 8, is shown in Table 2 below. The data shown in Table 2 and FIG. 9 was created using a 5 to 10 psi source of steam with a 0.125" diameter orifice and canister having a volume of 20 cubic inches containing the ferric aluminum silicate matrix between the steam source and coating chamber oven. The steam pressure in the coating chamber oven was typically from 0.5 to 2 psi, and coatings were generated by exposing to steam for 4 hours at 690° F. to 700° F.

TABLE 2

Core weight versus power loss for 6 months METGLAS ® 2605SA1 production

| Core Weight (lbs) | Loss Low Limit (W/lb)* | Median (W/lb)* | High Limit (W/lb)* |
|---|---|---|---|
| 0.05 | 9.8 | 11.9 | 14.0 |
| 0.08 | 10.2 | 10.5 | 10.7 |
| 0.22 | 9.0 | 9.0 | 9.0 |
| 0.31 | 9.6 | 10.5 | 11.5 |
| 0.36 | 10.8 | 12.1 | 13.4 |
| 0.41 | 8.1 | 8.8 | 9.6 |
| 0.43 | 9.3 | 12.7 | 16.1 |
| 0.435 | 16.2 | 18.7 | 21.1 |
| 0.58 | 9.3 | 11.9 | 14.5 |
| 0.70 | 14.1 | 14.6 | 15.1 |
| 0.705 | 9.3 | 11.5 | 13.7 |
| 0.77 | 10.6 | 12.6 | 14.6 |
| 0.83 | 10.2 | 15.3 | 20.3 |
| 1.06 | 13.3 | 16.1 | 18.9 |
| 2.41 | 13.9 | 13.9 | 13.9 |
| 2.42 | 10.3 | 12.5 | 14.8 |
| 4.50 | 9.1 | 10.3 | 11.4 |
| 5.20 | 8.5 | 9.2 | 10.0 |
| 5.73 | 1.5 | 1.5 | 1.5 |
| 5.97 | 11.2 | 15.4 | 19.5 |
| 6.37 | 7.5 | 7.9 | 8.3 |
| 6.57 | 11.4 | 14.3 | 17.1 |
| 8.32 | 10.1 | 10.2 | 10.2 |
| 8.6 | 9.5 | 9.5 | 9.5 |

*Power measured at 20 kHz and 0.2 tesla. Core average weight used to calculate watts/lb.

Preferably, the magnetic cores are annealed before or during the oxidative treatment which forms the insulating material on the surface of the metal ribbon. Annealing reduces the number of magnetic discontinuities in the magnetic core and can give the magnetic core desirable magnetic properties, as known to those of skill in the art. The presence of a full layer insulating metal oxide between core layers could interfere with the annealing process by introducing stress buildups. This is avoided by treating the cores to form the insulating material after the magnetic core has been wound and then during or after annealing. Because the process of the present invention produces metal oxide insulating materials at temperatures at or below the annealing temperature, this preferred sequence can be followed for most types of cores.

One embodiment which has produced good results is to anneal an amorphous metal alloy core (containing iron as the dominant metal) in air at a temperature of about 365° C. (690° F.) in the presence of a magnetic field to align the magnetic domains in the core. The oven temperature is then reduced to 305° C. to 329° C. (580° F. to 625° F.) before exposing the core to steam to form the iron oxide insulating layer. Even though annealing is done in air at a higher temperature than the temperature at which the insulating layer is formed by the process of the present invention, there are insufficient metal oxides present on the surfaces of the ribbon to provide dielectric insulation between the layers.

Another embodiment producing particularly good results is to treat an amorphous metal alloy core, having iron as the dominant metal, with steam and air while the core is being annealed. In other words, the insulating iron oxide coating formation and annealing take place simultaneously. The annealing temperature of the amorphous metal alloy will dictate the precise temperature for the treatment, as described above.

The coatings of the present invention also achieve superior performance by introducing or relieving mechanical stress. As known to those of skill in the art, power loss in soft magnetic cores has two components. The first component are eddy currents, which arise from voltages introduced in the substrate layers by flux variation. Eddy current losses are directly tied to the operational frequency of the induction coil, and play a minor role at low operational frequencies of 400 Hz or less, particularly for amorphous and nanocrystalline materials.

The second component of power loss results from the hysteresis effect, which is the amount of energy lost when the magnetic material repeats a magnetizing cycle. Stresses placed on a magnetic material can increase hysteresis losses, by affecting the motion of magnetic domains formed in the magnetic material. In particular, stress is most unfavorable on the hystersis loop for materials with large magnetostriction, such as amorphous metal alloys. The coatings of the present invention, when applied simultaneously with annealing of the metal ribbon, permits reduced stress on the underlying metal ribbons. It is believed that softness of the iron oxides of the coating contribute to this effect. Because the coating moves easily at typical core annealing temperatures, stresses are reduced on the metal ribbon because the coating acts as a lubricant relieving stresses on the metal ribbon during annealing, which improve its performance. For example, at low frequency operating conditions, where eddy current losses are insignificant, the simultaneously annealed and coated cores of the present invention exhibit improved performance in comparison to uncoated cores. See Table 3, below. This improved performance would not be expected simply from dielectric isolation of adjacent metal layers, and is attributable in part to stresses reduced on the metal ribbons which reduce hysteresis losses. Furthermore, the effect which relaxes stresses on the underlying metal ribbon is visually confirmed by fracture lines in the coating observable by microscopy.

Furthermore, coatings of the present invention do not introduce undesirable compressive stresses on the magnetic core due to heat expansion. It is known that the expansion coefficients of METGLAS® 2605SA1 and 2605SC are 7.6 and 5.9 ppm/° C., respectively. Common conventional materials used as insulation, such as magnesium oxide and MYLAR®, have expansion coefficients of 8, and 40 to 90 ppm/° C., respectively. Because the expansion coefficient of the insulation exceeds that of the metal, use of MgO or MYLAR® as insulation introduces compressive stresses in the operating temperature range. It is believed that this stress increases power losses of the core by approximately a factor of two. The present coating, however, does not introduce compressive stresses that would otherwise occur, thereby substantially improving performance.

Shown below in Table 3 is data comparing cores formed from treating METGLAS® 2605SA1 and 2605SC under conditions designed to eliminate stress. In particular, the coatings were formed by heating the wound cores to 670° F. to 690° F. for 4 hours, while simultaneously exposing the cores to steam at a pressure of 0.1 to 0.5 psi. The data for these cores is compared to cores formed by the magnesium methylate process (MgO). The results are shown in Table 3 and demonstrate a loss reduction of 50% in both amorphous materials for coated cores 2 and 4 as compared to standard magnesium methylate coatings of cores 1 and 3.

Processing Enhancements to Alter Magnetic Properties

The processing temperature at which coating occurs can be adjusted to tailor the basic magnetic properties of the resulting cores. For amorphous metal alloys such as Metglas® 2605SA1, exposure to steam at temperatures from about 388° C. (730° F.) to 427° C. (800° F.) tends to produce round and flat loop properties. Lower temperatures below about 379° C. (715° F.) tends to produce square loop properties, when a longitudinal magnetic field is applied during coating formation. Temperatures between about 379° C. and 388° C. (715° F. and 730° F.) tend to produce cores with round loop magnetic properties.

An example of a situation where flat loop properties are desired is for toroids, where the application may call for a gap to limit effective permeability. The gap however requires additional processing steps, and typically results in fairly large power dissipation compared to a toroid with no gap. Equivalent flat loop properties can be substituted for a gap in many cases with lower resultant power dissipation (because there is no gap) and potentially easier manufacturability (because there is no need to cut a gap).

Although it is possible to produce flat hysteresis loops using conventional processes and lower temperature annealing in the presence of transverse magnetic fields, it is more difficult. The reason is that transverse magnetic fields are perpendicular to the circumferential direction (in the direction of the strip width), requiring a special magnetic field generator. The magnetic field generator is typically either a current carrying multiple turn solenoid, built from very heavy gage wire wrapped on a tube or pot inside the oven, or is an electrified externally placed large C core shaped electromagnet with a gap through which a heated tunnel with properly oriented cores is routed. In the latter case the oven must be specifically designed for transverse field annealing, and is typically limited to very specific core sizes. The solenoid pot is usually very limited in the number of parts which can be transverse and is susceptible to excessive process variation. However, when the present invention is used in combination with the proper annealing temperature, formation of a flat hysteresis loop is much easier.

More specifically, when METGLAS® 2605SA1 is heated in the presence of steam at a temperature of 715° F. for 4

TABLE 3

METGLASS ® 2605SA1 & 2605SC: 5.25" OD × 4.0" ID × 2" SW

| # | Material Processing Condition | Core kW | Start Amps | Set Amps | Pulse J/m$^3$ |
|---|---|---|---|---|---|
| 1 | 2605SA1, standard (MgO) | 95.3 | 25 | 42 | 810 |
| 2 | 2605SA1, coated, zero stress ΔB = 2.8T, 2 μs | 57.7 | 10 | 20 | 490 |
| 3 | 2605SC, standard (MgO) ΔB = 2.6T, 2 μs | 102 | 25 | 40 | 867 |
| 4 | 2605SC, coated, zero stress ΔB = 3.05T, 2 μs | 61 | 10 | 20 | 518 |

Conditions: 5.35 to 5.8 kV applied to cores using 6 turn primary, 10 pps, and a 2 μsec pulse width, flux swing 2.8 to 3.05 T.

hours or less using longitudinal magnetic fields to orient the domains, then normal square loop properties always result. This has been verified in production for cores ranging from less than 1 pound to over 40 pounds. There is no sharp cutoff in the transition between the square, round and flat loop states for temperatures approaching 715° F. to 730° F. and upward, because coating time and temperature interact in synergistic ways above critical activation temperatures. Coating times of 4 hours or greater above 730° F. in the presence of steam can result in flat loop cores when the cores are small, i.e., less than 1 pound. Other amorphous metals, such as METGLAS® 2605SC, behave similarly, although the recited temperatures may differ slightly.

There are two technologically important classes of magnetic amorphous alloys: the transition metal (TM)—metalloid (M) alloys and the rare earth-transition metal alloys. METGLAS® 2605SA1 and its equivalent commercial counterparts are transition metal-metalloid alloys, which broadly speaking contain approximately 80% atomic weight of one or more of: Fe, Co or Ni with the remaining 20% being B, C, Si, P or Al. The #2605 alloy is 80% Fe and 20% B, which is apparently the grandparent for modem METGLAS® 2605XXX alloys. The metalloid components are necessary to lower the melting point so that the alloys can be rapidly quenched through their glass transition temperature. The very same metalloids also stabilize the resultant quenched amorphous phase, and reduce the saturation magnetization and glass transition temperature compared to comparable crystalline alloys.

These alloys are of major interest because their presumed isotropic character has been shown to result in very low coercivity and hysteresis loss and high permeability, a combination which is commercially very important for high frequency applications. However their weakness is tied to the metastable state, which can lead to eventual crystallization despite the presence of the metalloid stabilizers. Given this, a considerable amount of research has been tied to TM-M amorphous alloy stability and crystallization time constants. This is because the end of life as far as magnetic applications are concerned corresponds to the onset of crystallization. In the crystallization temperature range the coercive force and power losses increase and the remanence and permeability decrease, all at a very rapid rate for a small increase in temperature. This is one of the reasons the continuous service temperature for METGLAS® 2605SA1 is rated at a fairly conservative 150° C. Likewise because of this effect it is possible to tailor the permeability by annealing cores in the crystallization temperature range for a controlled amount of time.

The stability of TM-M alloys has been found to correlate with the difference between crystallization onset temperature and the glass transition temperature. Between the melt temperature and glass transition temperature, $T_g$, crystallization increases rapidly as $T_g$ is approached. On the other hand crystallization decreases rapidly as the crystallization onset temperature falls below $T_g$. Therefore, the glass transition temperature is an important parameter for the discussion of crystallization onset time constants. $T_g$ for #2605 alloy is published to be 441° C. or 825.8° F. Honeywell does not publish $T_g$ for METGLAS® 2605SA1 or for that matter for any of METGLAS® alloys. It does however publish the crystallization temperature for 2605SA1 and other METGLAS® alloys, which for 2605SA1 is 945° F., which is approximately 120° F. higher than the $T_g$ for #2605 alloy. Assuming that Honeywell's crystallization temperature is in fact $T_g$, the published crystallization onset temperature of #2605 alloy for a given annealing time is probably on the order of 120° F. lower than for the 2605SA1 amorphous composition. The reason for this substantial difference may be that 2605SA1 is significantly different from the #2605 alloy chemically with possible additions of other elements.

Given this foundation and based on graphs shown in Chapter 6 of Wohfarth, "Ferro—Magnetic Materials," Volume 1, (North Holland Publication), it appears that crystallization onset occurs after 2 to 5 hours at 600° F. to 610° F. for #2605 alloy. It is therefore estimated that for 2 to 5 hours of annealing time, crystallization probably onsets for the 2605SA1 alloys above 690° F. in the 720° F. to 730° F. range, based on the comparison of permeability and power loss measurements at 690° F. and 730° F. This observation is quite consistent with the differences between #2605 alloy's $T_g$ and 2606SA1 alloy's published crystallization temperature.

The data in the following tables and corresponding figures were accumulated by selecting two standard Honeywell part numbers to test both standard and non-standard coating temperatures, keeping the coating processing time a constant 4 hours with an additional one hour of temperature settling time. For this testing, both selected parts were "C" cores fabricated from METGLAS® 2605SA1 with a standard 1 mil gage, one with an approximate 0.75 lb. weight and the other with an approximate 2.5 lb. weight. The larger core is roughly 1.8 to 2 times larger in window dimensions, cross sectional area, path length than the smaller core with proportional increases in window area and mass. The strip widths of both cores were each about 1.25 inches. The tabular data and graphs for the larger core tracked the results for the smaller core. Therefore, only the data for the smaller core is presented for the sake of succinctness. As set forth herein and in the figures, the term "coated" refers to a core which has been treated with the combination of heat and steam to form iron oxide insulative material between the layers of the laminate. The term "uncoated" refers to cores which have not been treated with steam, and which do not have sufficient iron oxide insulation between laminate layers.

In these tests, data was accumulated using the aforedescribed 4 hour treatment, one hour settling process as a thermal model for annealing, except that a different temperature was substituted for 690° F., i.e., one of 715° F., 730° F., 750° F., 760° F., 770° F. 780° F. or 800° F. The standard 690° F. processing was also done in the same test group to compare the unusual annealing temperature results with standard processing. In order to better observe the effects of the coating at the listed temperatures, starting at 690° F. and ranging for a total of 8 steps to 800° F., testing was done with and without the coating process. Where coating was provided, processing was done using the ferric aluminum silicate transference matrix described above. For the tests where no coating was applied, the thermal processing time was kept at 5 hours to fully duplicate the annealing time conditions of one hour of stabilization and 4 hours of exposure to steam and heat, or 5 hours total annealing time. Testing was done for the three major processing steps: (1) after annealing; (2) after impregnation with an epoxy resin; and (3) after final processing. Longitudinal magnetic fields were applied where appropriate to achieve maximum saturation magnetization. When a longitudinal magnetizing field was used, the term Square (Sq) appears in the tables below. When no field was used, the term Round (Rd) appears. Therefore, for the most part magnetic fields were not used above the Curie temperature of roughly 765° F. for these annealing conditions. Following the extensive testing done over 8 different temperatures, a very small "C" core was processed in larger numbers at 690° F. to 710° F. and 730° F. to 745° F. to confirm some observations made with the first group. This core had an approximate weight of approximately 0.1 lb. This follow-up testing of the very small core confirmed the more important conclusions reached with the smaller group tested over a larger temperature range.

The permeability parameter is the slope of the line from the zero drive, zero flux point on the magnetization curve to the flux level for which it is defined.

TABLE 4

Magnetization curve core flux (kG) - impregnated 0.75# core - uncoated

| Drive | 690° F. | 715° F. | 730° F. | 750° F. | 750° F. | 760° F. | 770° F. | 780° F. | 800° F. | 800° F. |
|---|---|---|---|---|---|---|---|---|---|---|
| 0.1 | 0.79 | 0.58 | 0.30 | 0.25 | 0.25 | 0.12 | 0.08 | 0.04 | 0.04 | 0.04 |
| 0.5 | 4.90 | 4.52 | 3.32 | 2.91 | 2.66 | 1.74 | 1.08 | 0.50 | 0.08 | 0.08 |
| 1.0 | 6.52 | 6.31 | 5.02 | 4.73 | 4.36 | 3.24 | 2.41 | 1.29 | 0.25 | 0.25 |
| 2.0 | 8.18 | 8.22 | 6.72 | 6.72 | 6.35 | 5.15 | 4.14 | 2.66 | 0.71 | 0.71 |
| 3.0 | 9.25 | 9.46 | 7.80 | 7.93 | 7.64 | 6.43 | 5.35 | 3.74 | 1.33 | 1.12 |
| 4.0 | 10.00 | 10.29 | 8.47 | 8.76 | 8.47 | 7.35 | 6.23 | 4.61 | 1.58 | 1.49 |
| 5.0 | 10.62 | 10.96 | 9.09 | 9.55 | 9.30 | 8.09 | 7.06 | 5.35 | 1.99 | 1.87 |
| (Oe) | Square | Square | Square | Square | Round | Round | Round | Round | Square | Round |

All measurements shown in Table 4 were made using a Magnetic Metals Constant Current Flux Reset Test Set (CCFR), which was adjusted for the proper core cross sectional area and path length to give a calibrated flux level in kiloGauss (kG) and drive in Oersteds (Oe). In addition, the flux densities were adjusted to be consistent with a 15.9 kG saturation level, expected for the uncoated and unimpregnated processing results of METGLAS® 2605SA1.

Figure 9:
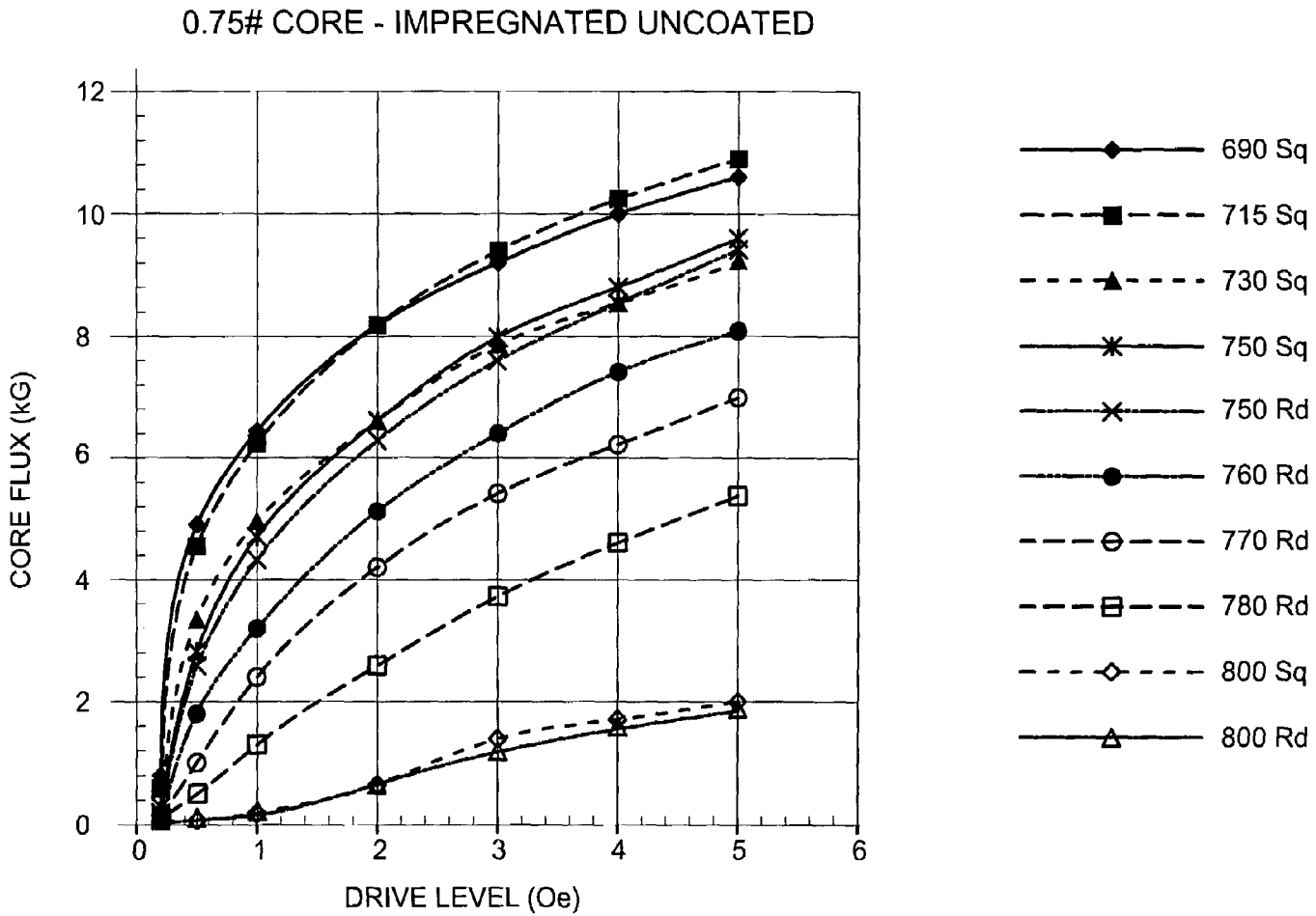
FIG. 9 is a plot of core flux versus drive level for uncoated impregnated cores.
Figure 16:
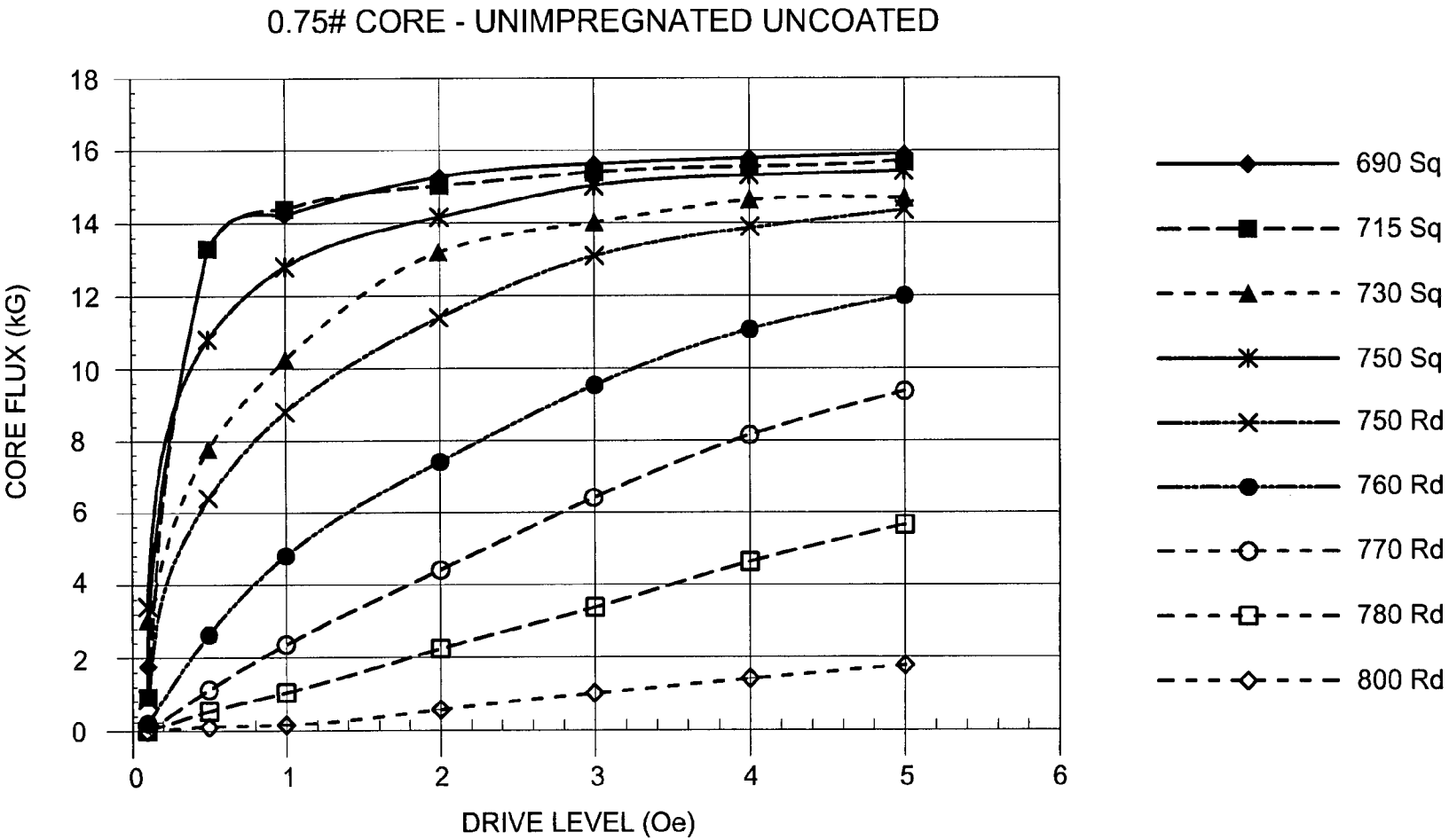
FIG. 16 is a plot of core flux versus drive level for uncoated unimpregnated cores.

Table 4 and corresponding FIG. 9 show a generally decreasing magnetization curve as the annealing temperature increases from 690° F. to 800° F. Further no square loop effects are evident in this data, despite the fact that the 690° F., 715° F. and 730° F. and part of the 750° F. data was taken using longitudinally "Square Loop" magnetized cores. This result is a consequence of the impregnation stress, since squareness is strongly evident in the pre-impregnated data, i.e., core flux ranges from no less than 15 kG to 15.9 kG, from 3 Oe to the maximum drive of 5 Oe, for the temperatures mentioned. See FIG. 16 which shows the magnetization curves for the unimpregnated 0.75 lb. uncoated cores over the 690° F. to 800° F. range.

It is believed that the reason for this effect is that stress reduces permeability. See Bozworth, "Ferromagnetism," IEEE Press (1983) (Chapter 13, Stress and Magnetostriction). The applicable equation is: $\mu_0-1=8\pi I_s^2/9\lambda_s\sigma_i$ where $\mu_0$ is the initial permeability; $I_s$ is the magnetic moment per unit volume at saturation, which is proportional to the saturation flux density; $\lambda_s$ is the saturation magnetostriction; and $\sigma_i$, is the internal stress in a single domain. Since the saturation magnetostriction for 2605SA1 is quite large, i.e., 27 ppm, the effect of even small impregnation stresses can be quite large.

TABLE 5

Perm and power loss - 2 kG flux density - impregnated 0.75# core - uncoated

| Factor | 690° F. | 715° F. | 730° F. | 750° F. | 750° F. | 760° F. | 770° F. | 780° F. | 800° F. | 800° F. |
|---|---|---|---|---|---|---|---|---|---|---|
| Watts/# | 16.73 | 10.38 | 26.99 | 16.46 | 10.83 | 17.50 | 16.42 | 17.51 | 20.56 | 26.36 |
| Perm | 9,176 | 8,198 | 6,096 | 5,499 | 5,115 | 3,413 | 2,362 | 1,315 | 398 | 374 |

Figure 6:
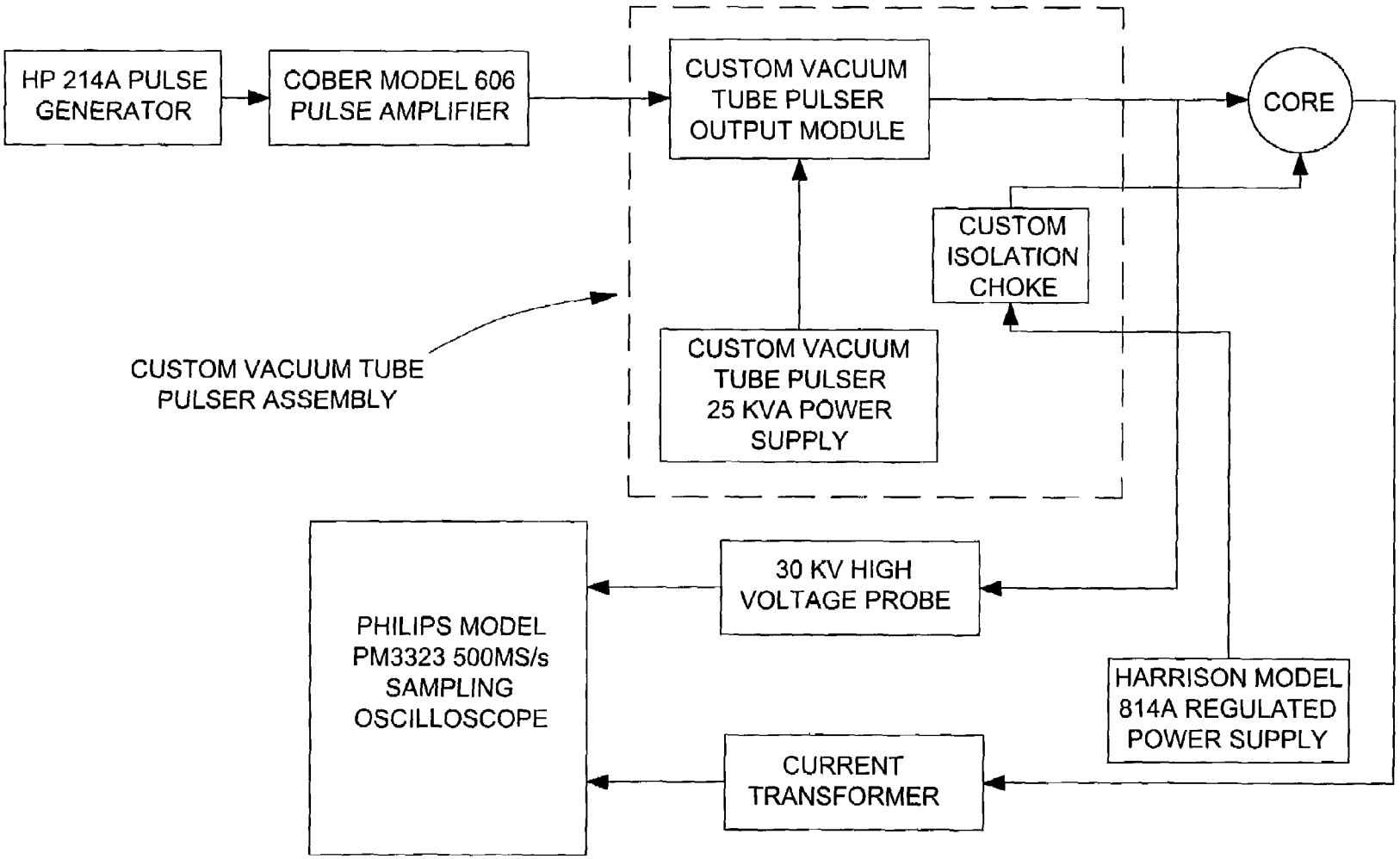
FIG. 6 is a schematic diagram of the pulse tester apparatus used to perform the toroid pulse testing.
Figure 10:
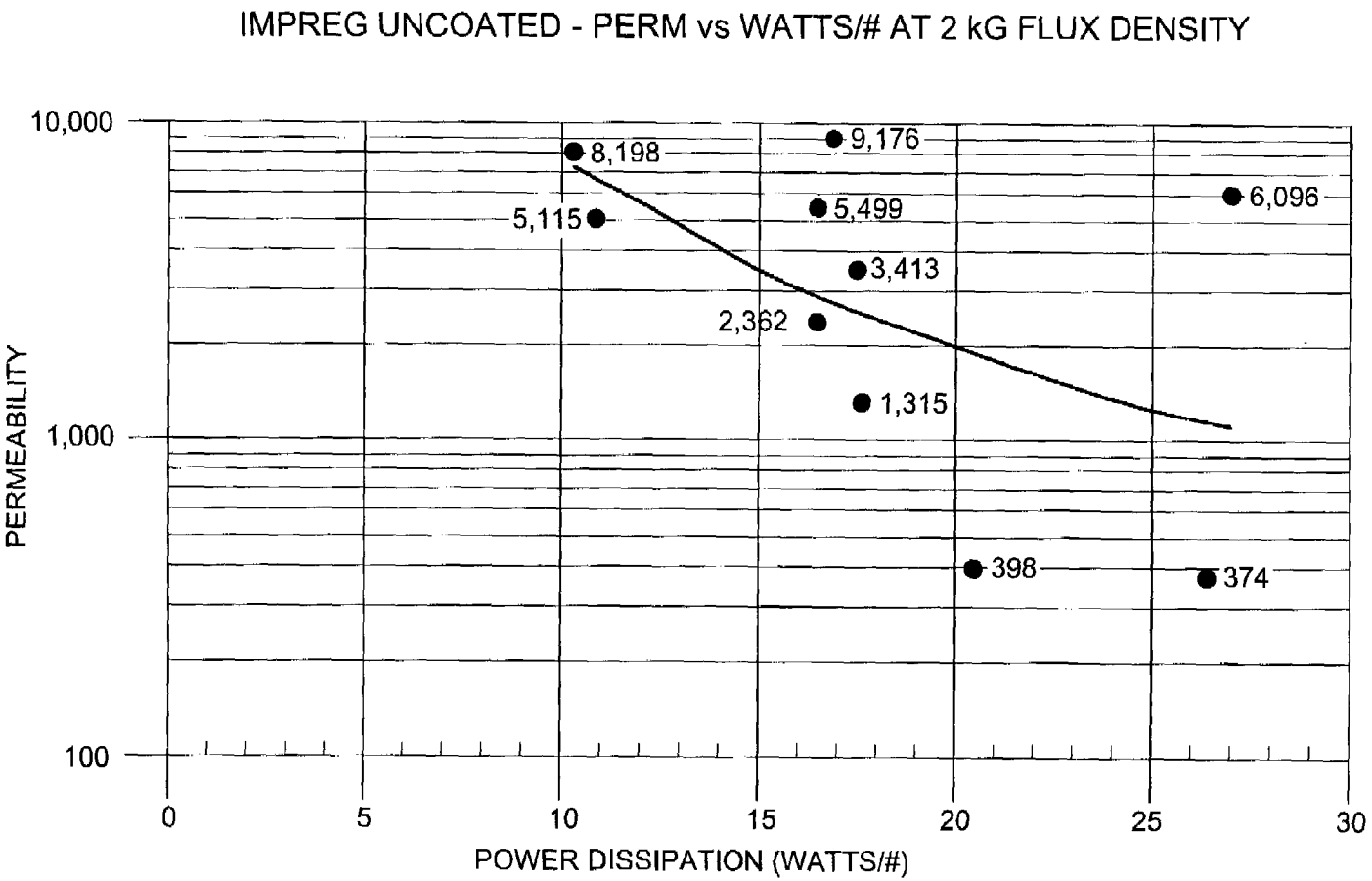
FIG. 10 is a plot of permeability versus power dissipation (in watts/pound) for uncoated impregnated cores.
Figure 11:
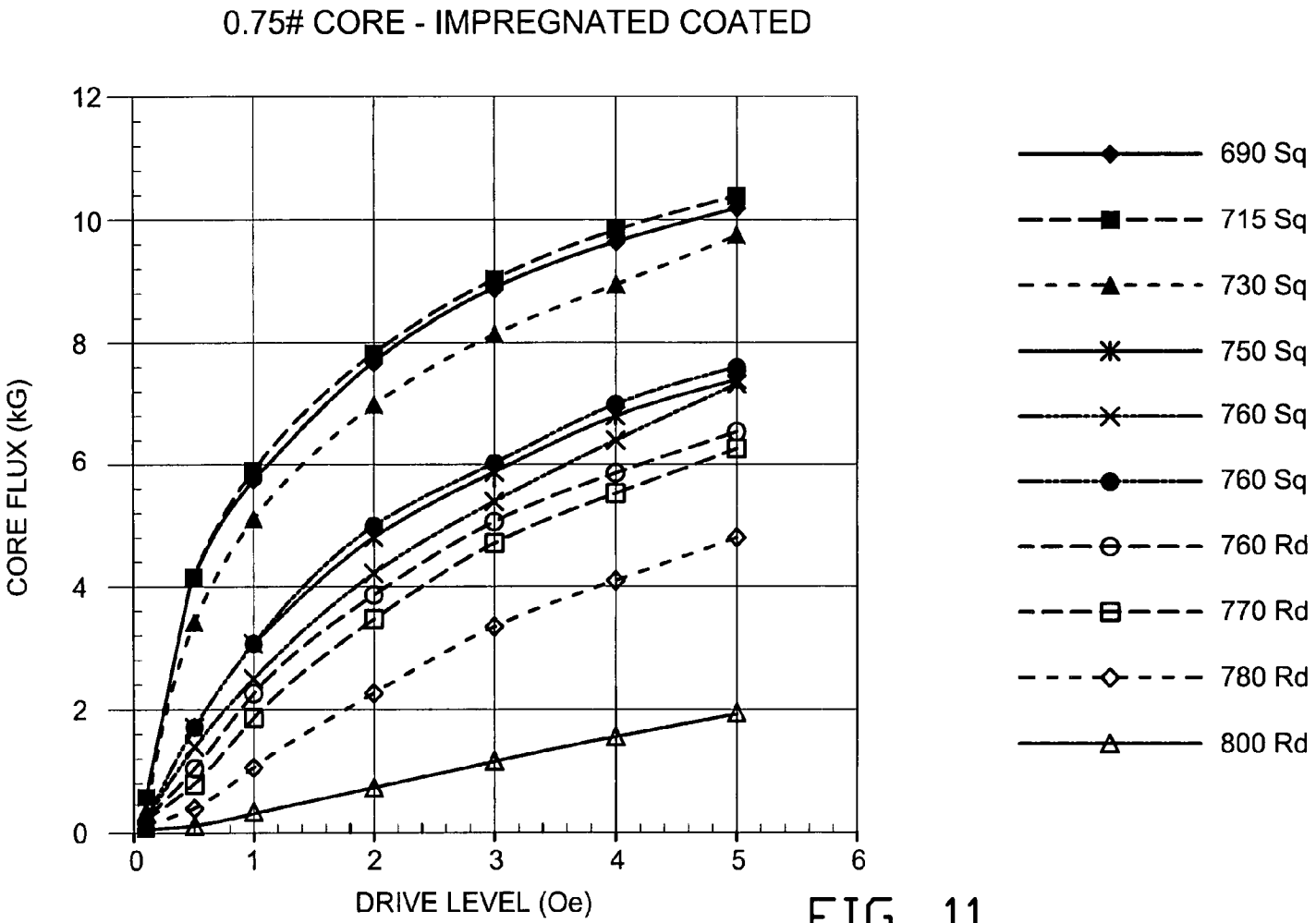
FIG. 11 is a plot of core flux versus drive level for coated impregnated cores.

The permeability (perm) in Table 5 was calculated at the 2 kG flux level from the data in Table 4. The core loss was measured at 20 kHz and 2 kG, using a test set fully described below in the Examples section and FIG. 6. The test condition for power measurement at 2 kG for this core is: 43.9 volts using a 10 turn solenoid coil. Data for this test is also plotted in FIG. 10.

Figure 17:
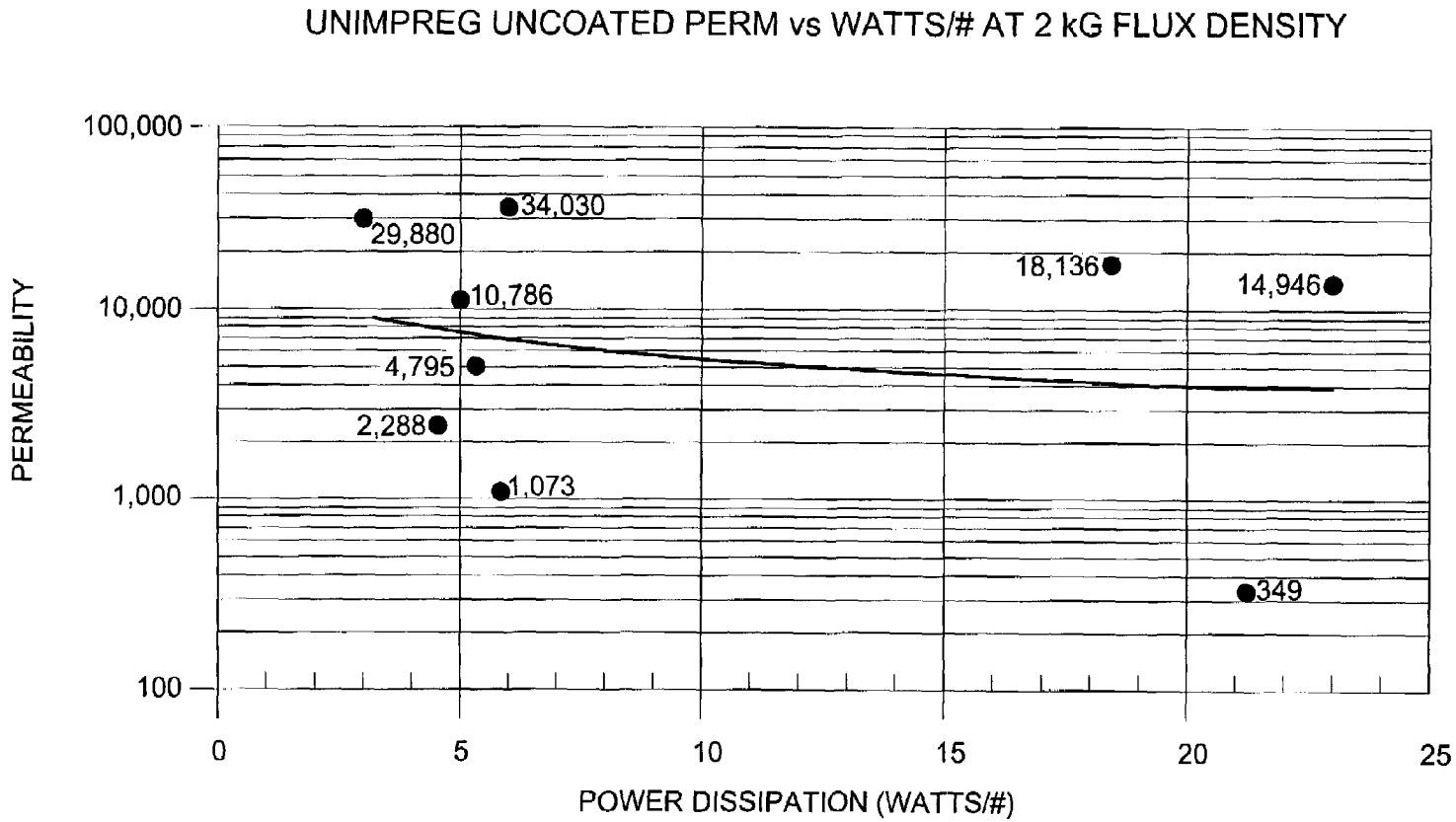
FIG. 17 is a plot of permeability versus power dissipation (in watts/pound) for uncoated unimpregnated cores.

The power loss is typically higher than for unimpregnated cores. FIG. 17 is the equivalent of FIG. 10 for the unimpregnated 0.75# cores over the 690° F. to 800° F. range. Note the increase in power dissipation for the impregnated but uncut cores.

TABLE 6

Magnetization curve core flux (kG) - impregnated 0.75# core - coated

| Drive | 690° F. | 715° F. | 730° F. | 750° F. | 760° F. | 760° F. | 760° F. | 770° F. | 800° F. | 800° F. |
|---|---|---|---|---|---|---|---|---|---|---|
| 0.1 | 0.54 | 0.58 | .37 | 0.12 | 0.12 | 0.12 | 0.08 | 0.08 | 0.04 | 0.04 |
| 0.5 | 4.15 | 4.15 | 3.40 | 1.70 | 1.33 | 1.66 | 1.04 | 0.83 | 0.37 | 0.08 |
| 1.0 | 5.81 | 5.93 | 5.10 | 3.07 | 2.49 | 3.07 | 2.24 | 1.87 | 1.04 | 0.29 |
| 2.0 | 7.64 | 7.80 | 6.97 | 4.77 | 4.23 | 4.86 | 3.86 | 3.49 | 2.28 | 0.71 |
| 3.0 | 8.76 | 8.96 | 8.13 | 5.93 | 5.48 | 6.06 | 5.06 | 4.69 | 3.28 | 1.12 |
| 4.0 | 9.55 | 9.79 | 8.96 | 6.81 | 6.39 | 6.97 | 5.89 | 5.56 | 4.07 | 1.49 |
| 5.0 | 10.21 | 10.42 | 9.67 | 7.51 | 7.39 | 7.72 | 6.64 | 6.35 | 4.81 | 1.91 |
| (Oe) | Square | Square | Square | Square | Square | Square | Round | Round | Round | Round |

Figure 18:
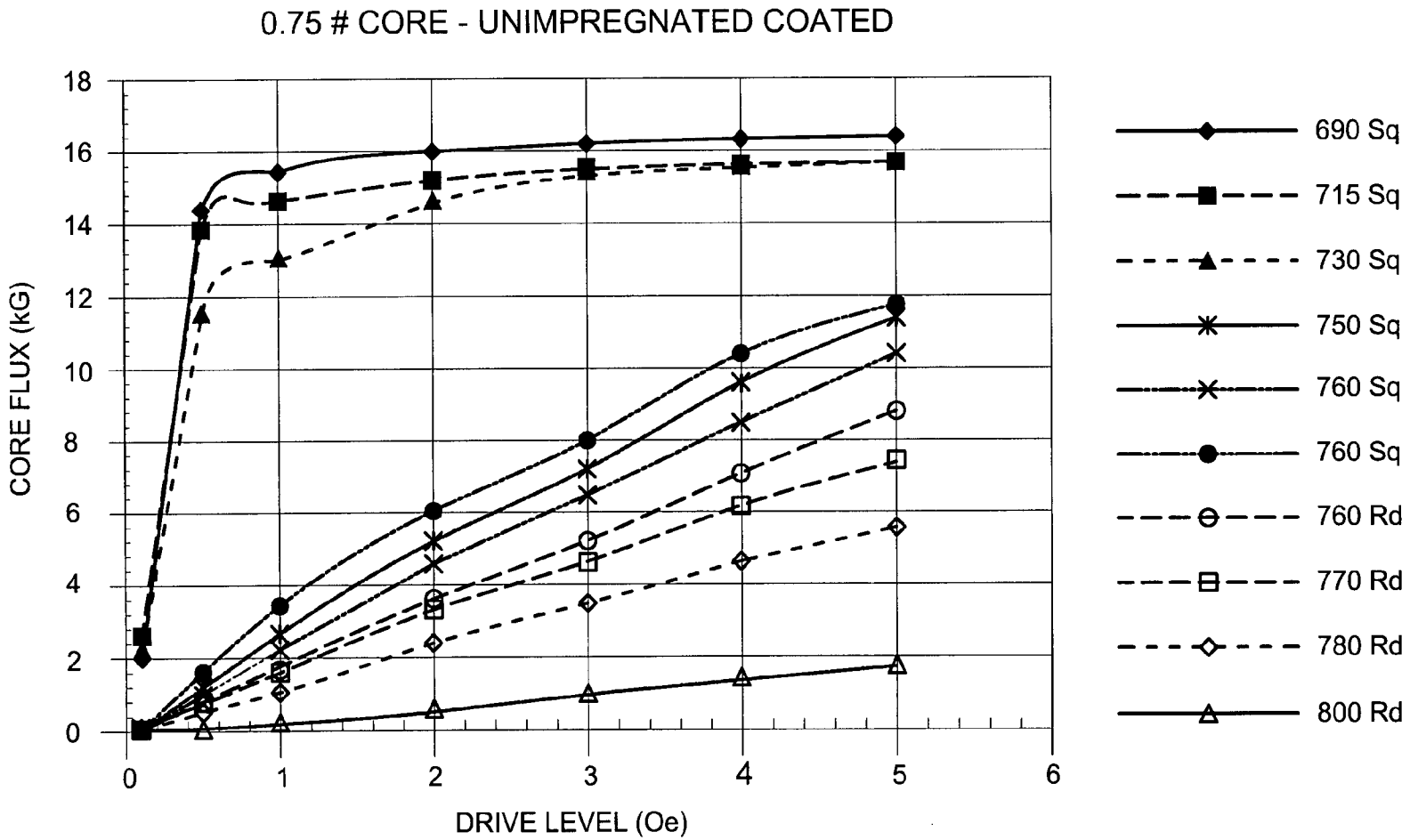
FIG. 18 is a plot of core flux versus drive level for coated unimpregnated cores.

The comments for Table 4 apply equally to Table 6. The coating of the present invention seems to have a slightly greater effect on rounding or flattening, depending on the temperature, than the uncoated cores. However the differences are too small to be noticed in view of the stresses experienced by the impregnated cores. The equivalent data for the unimpregnated cores also shows no significant differences between coated and uncoated cores. It is only when permeability and power loss are considered as a crystallization effect that differences emerge. The unimpregnated coated cores in FIG. 18 are very "square" for temperatures below 750° F., and "flat" at 760° F. and beyond. The impregnation effect for coated cores significantly reduces the permeability for each annealing temperature except 800° F. Qualitatively the effect is the same as observed for the uncoated cores, except that the 715° F. annealing temperature results in a higher saturation flux (higher than for the 690° F. annealing temperature) comparing the unimpregnated coated cores to the uncoated ones. The differences between the 690° F. and 715° F. for unimpregnated cores is not very large.

TABLE 7

Perm and power loss - 2 kG flux density - impregnated 0.75# core - coated

| Factor | 690° F. | 715° F. | 730° F. | 750° F. | 760° F. | 760° F. | 760° F. | 770° F. | 780° F. | 800° F. |
|---|---|---|---|---|---|---|---|---|---|---|
| Watts/# | 8.66 | 7.19 | 7.99 | 11.11 | 9.56 | 9.97 | 11.28 | 10.5 | 11.84 | 22.87 |
| Perm | 7,639 | 7,721 | 6,354 | 3,284 | 2,534 | 3,223 | 2,233 | 1,849 | 1,128 | 382 |

Figure 12:
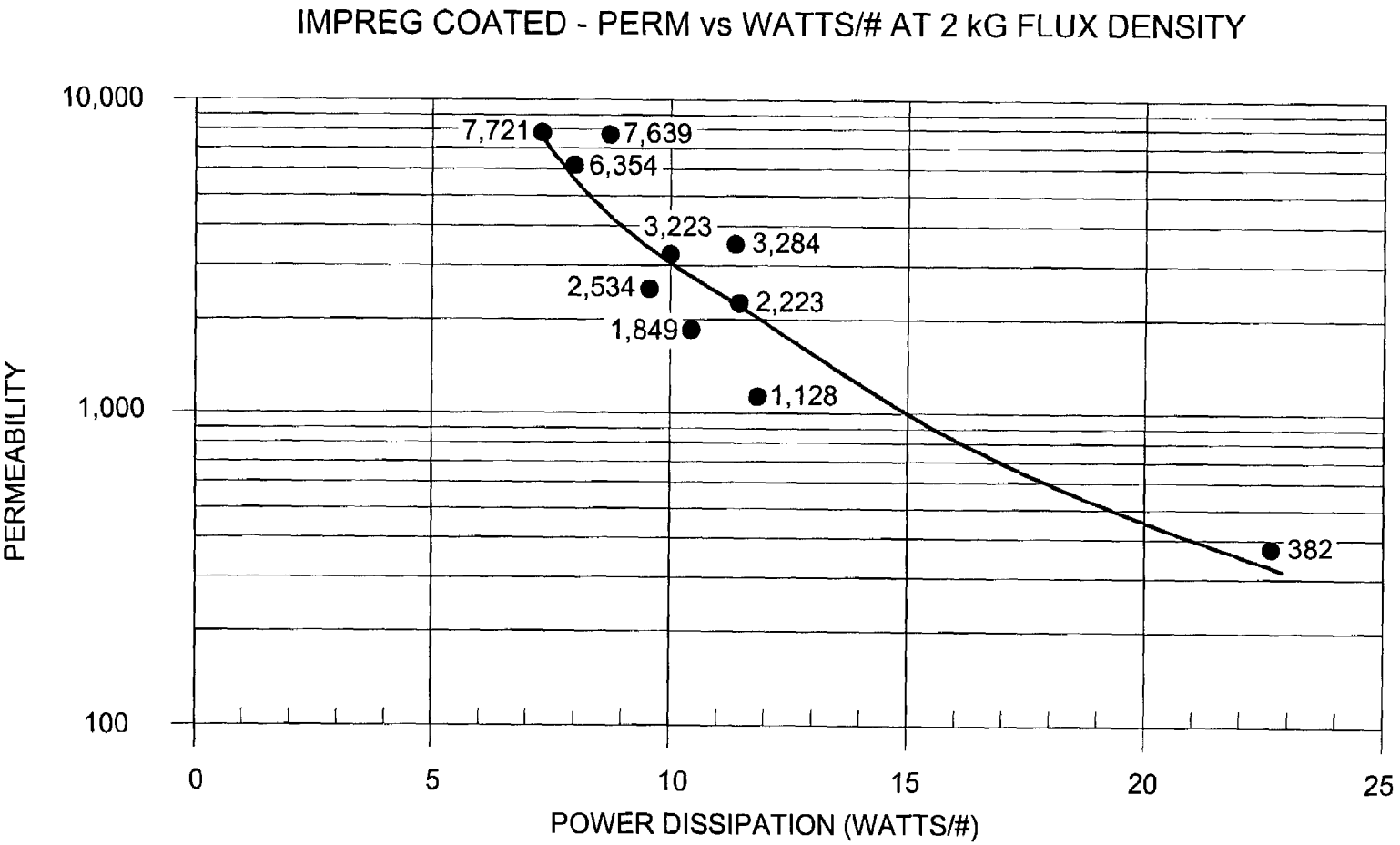
FIG. 12 is a plot of permeability versus power dissipation (in watts/pound) for coated impregnated cores.

The comments for Table 5 apply equally to Table 7. However, the comparison of Table 7 (coating of the invention) with Table 3 (uncoated) shows a clear difference, which is more evident from their equivalent figures, i.e., FIG. 12 and FIG. 10. These figures show that power loss is reduced for coated cores, and that there is significantly less scatter in the plot of permeability versus power loss at 2 kG for coated cores compared to uncoated cores. Because permeability and power loss should be inversely related in the crystallization zone, as observed for the coated cores, the additional power loss and scatter for the uncoated cores are due to something else.

Figure 19:
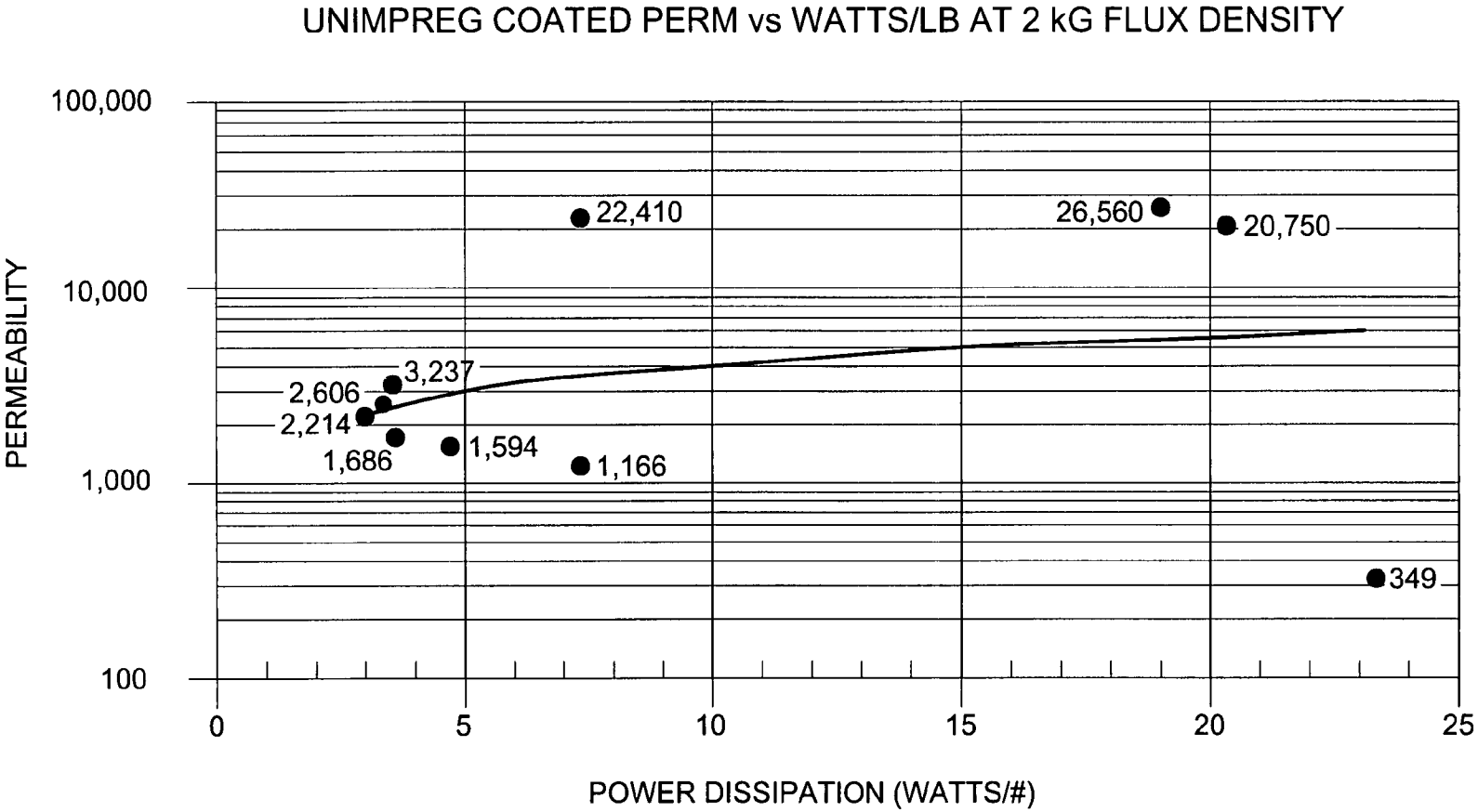
FIG. 19 is a plot of permeability versus power dissipation (in watts/pound) for coated unimpregnated cores.

These differences are not apparent for coated and uncoated cores before impregnation, as seen by comparing FIG. 17 (uncoated) with FIG. 19 (coated). FIG. 17 and FIG. 19 show approximately equal core loss and scatter. It is only when impregnation stresses are present in addition to the crystallization component that differences emerge.

The uncoated permeability versus power loss should show a smooth downward trend if most of the power loss is because of increased crystallization as the temperature increases. However since there is much more scatter in the uncoated data than can be explained from simple crystallization effects alone, the additional power loss must be due to larger impregnation stresses compared to the coated cores.

This conclusion is both consistent with the lack of differences between unimpregnated cores, and the observation that the differences become smaller for impregnated cores as the annealing temperature increases. The crystallization component of stress gets larger with increased annealing temperatures while the impregnation stress stays constant regardless of annealing temperature. Therefore the balance shifts slowly to a higher crystallization contribution to power loss at higher annealing temperatures for impregnated cores. Note that there is no substantial improvement at 800° F. for coated and impregnated cores.

TABLE 8

Perm and annealing temperature (° F.) - imprenated 0.75# core - uncoated

| Temp (° F.) | 0.1 Oe | 0.5 Oe | 1.0 Oe | 2.0 Oe | 3.0 Oe | 4.0 Oe | 5.0 Oe | Average |
|---|---|---|---|---|---|---|---|---|
| 690 | 7,885 | 9,794 | 6,516 | 4,088 | 3.085 | 2,500 | 2,125 | 5,142 |
| 715 | 5,810 | 9,047 | 6,308 | 4,109 | 3,154 | 2,573 | 2,191 | 4,742 |
| 730 | 2,490 | 6,640 | 5,022 | 3,362 | 2,601 | 2,117 | 1,818 | 3,435 |
| 730 | 2,490 | 5,561 | 4,544 | 3,268 | 2,594 | 2,153 | 1,884 | 3,213 |
| 760 | 1,245 | 3,486 | 3,237 | 2,573 | 2,144 | 1,836 | 1,619 | 3,306 |
| 770 | 830 | 2,158 | 2,407 | 2,075 | 1,785 | 1,556 | 1,411 | 1,746 |
| 780 | 415 | 996 | 1,287 | 1,328 | 1,245 | 1,152 | 1,071 | 1,070 |
| 800 | 415 | 166 | 249 | 353 | 408 | 384 | 386 | 337 |

Figure 13:
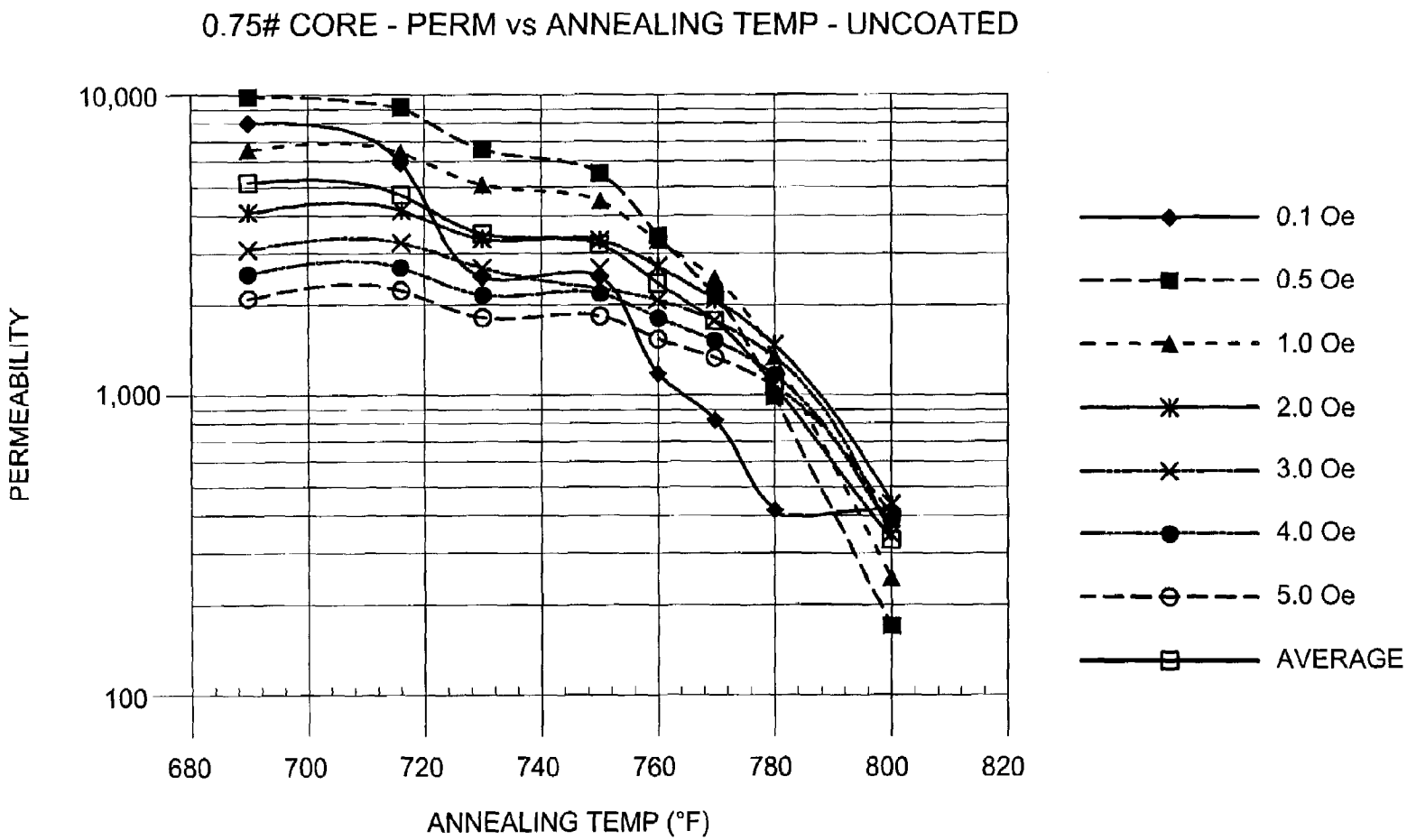
FIG. 13 is a plot of permeability versus annealing temperature for uncoated cores.

The permeabilities in Table 8 were calculated from the data in Table 4 for each combination of temperature and drive level as the ratio of the flux density measured to the given drive level. Note the notch in FIG. 13 at 730° F. For METGLAS® 2605SA1, 730° F. is the estimated theoretical temperature of crystallization onset for 5 hours of annealing. FIG. 13 definitely shows a transition from a relatively stable permeability range from 0.1 Oe to 5.0 Oe below 730° F., to a noticeably steep decline, starting somewhere around 750° F. or slightly higher. The average is approximately linear beyond 750° F. in the log-perm versus temperature plot. The permeability also changes relatively slowly over the 0.1 Oe to 5.0 Oe range beyond 750° F. except for some anomalies at the very low 0.1 Oe level. The magnetization curve is changing from a "round" to a "flat" loop in the 730° F. to 750° F. range. A careful review of Table 4 and FIG. 9 shown the same effects.

TABLE 9

Perm and annealing temperature (° F.) - impregnated 0.75# core - coated

| Temp (° F.) | 0.1 Oe | 0.5 Oe | 1.0 Oe | 2.0 Oe | 3.0 Oe | 4.0 Oe | 5.0 Oe | Average |
|---|---|---|---|---|---|---|---|---|
| 690 | 5,395 | 8,300 | 5,810 | 3,818 | 2,919 | 2,386 | 2,042 | 4,381 |
| 715 | 5,810 | 8,300 | 5,935 | 3,901 | 2,988 | 2,449 | 2,083 | 4,494 |
| 730 | 3,735 | 6,806 | 5,106 | 3,486 | 2,711 | 2,241 | 1,934 | 3,717 |
| 750 | 1,245 | 3,403 | 3,071 | 2,386 | 1,978 | 1,702 | 1,502 | 2,184 |
| 760 | 1,107 | 2,684 | 2,601 | 2,158 | 1,844 | 1,605 | 1,450 | 1,921 |
| 770 | 830 | 1,660 | 1,878 | 1,743 | 1,563 | 1,390 | 1,270 | 1,475 |
| 780 | 414 | 747 | 1,038 | 1,141 | 1,093 | 1,017 | 963 | 916 |
| 800 | 415 | 166 | 291 | 353 | 374 | 374 | 382 | 336 |

Figure 14:
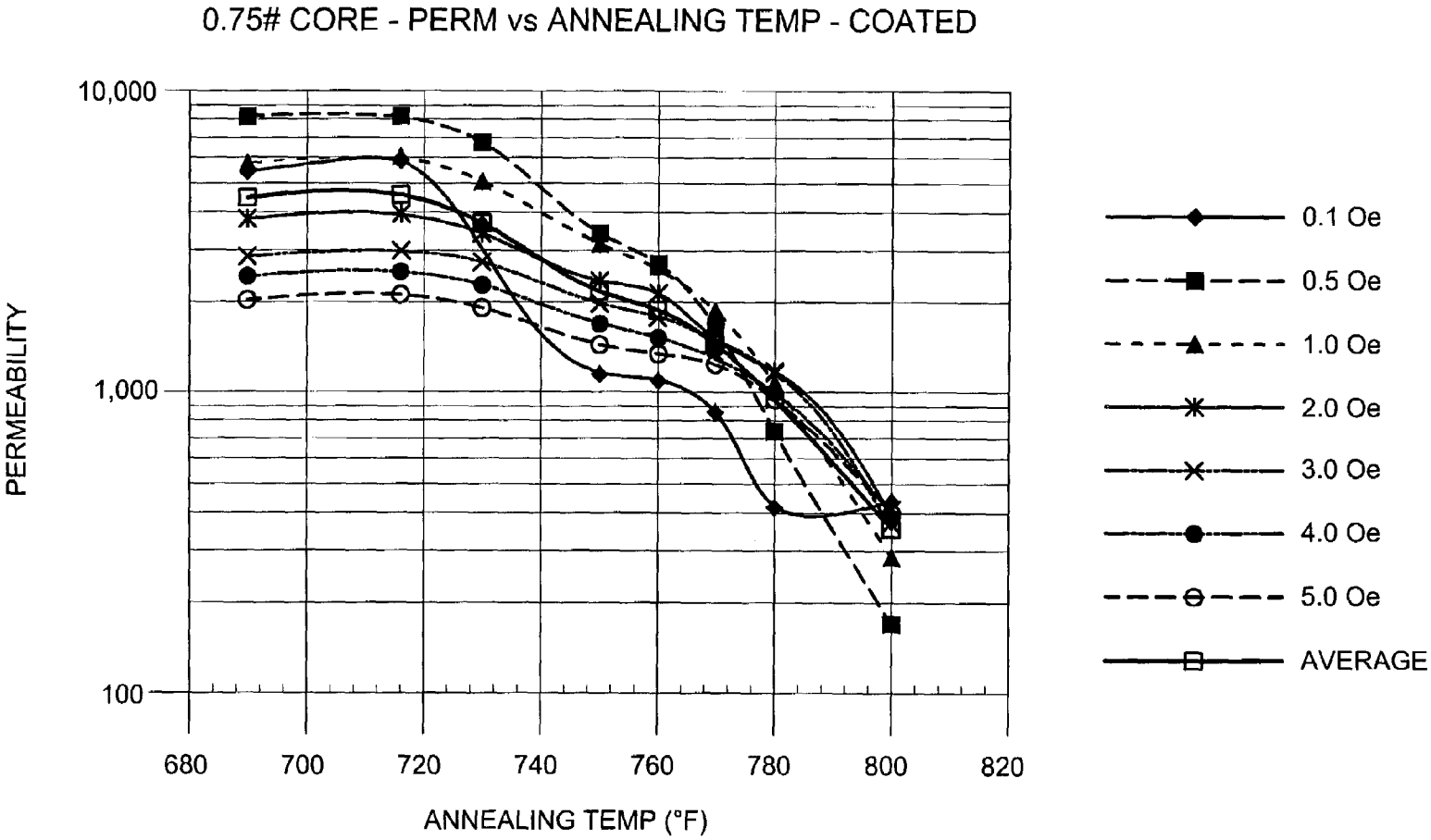
FIG. 14 is a plot of permeability versus annealing temperature for coated cores.
Figure 15:
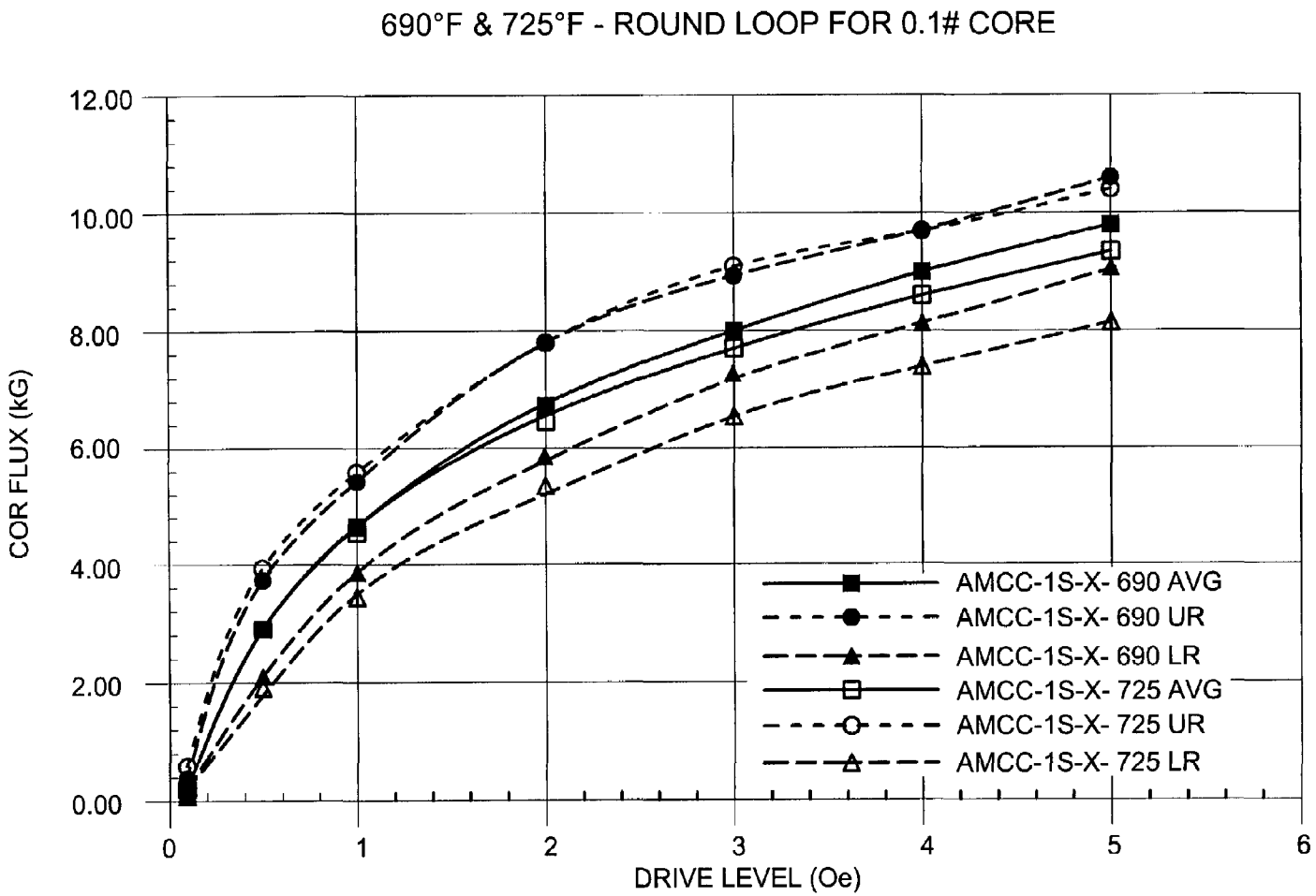
FIG. 15 is a plot of core flux versus drive level for 0.1 pound cores treated at 690° F. and 725° F. under round loop conditions.

The permeabilities in Table 9 were calculated from the data in Table 6 for each combination of temperature and drive level as the ratio of the flux density measured to the given drive level. The notch at 730° F., noted for Table 8, has been replaced by a definite trend downward in Table 9. See FIG. 14. The coating of the present invention is helping the transition to crystallization at slightly lower temperatures. The Arrhenius nature of the log-perm versus temperature plot in FIG. 14 is more pronounced than for FIG. 13 and starts sooner, i.e., 740° F. All other observations, made for Table 8, apply to Table 9.

The larger 2.5# core showed that same trends as the smaller 0.75# core, having somewhat different saturation inductance and permeability scaling effects.

Table 10 compiles power loss data taken at 20 kHz and 2 kG at the 8 distinct temperatures used for data collection points, starting at 690° F. and finishing with 800° F. The 0.75 lb. (#) core was used for this data. The 2.5 lb. core showed similar results.

TABLE 10

Comparison of power loss (watts/lb) of coated and uncoated cores

| | Unimpregnated (W/lb) | | Impregnated (W/lb) | | Finished (W/lb) | | % Improve- |
|---|---|---|---|---|---|---|---|
| Temp (° F.) | Coated | Uncoated | Coated | Uncoated | Coated | Uncoated | finished cores |
| 690 Square | 20.36 | 18.44 | 8.66 | 16.73 | 10.03 | 18.27 | 45% |
| 715 Square | 19.0 | 23.02 | 7.19 | 10.38 | 8.25 | 12.03 | 31% |
| 730 Square | 7.39 | 3.1 | 7.99 | 26.99 | 8.24 | no data | insuff. Data |
| 750 Square | 3.19 | 6.0 | 11.11 | 16.46 | 12.68 | 17.31 | 12% |
| 750 Round | | 4.97 | | 10.93 | | 11.49 | |
| 760 Square | 2.9 | 5.33 | 9.56 | 17.5 | 11.76 | 16.64 | |

TABLE 10-continued

Comparison of power loss (watts/lb) of coated and uncoated cores

| Temp (° F.) | Unimpregnated (W/lb) Coated | Unimpregnated (W/lb) Uncoated | Impregnated (W/lb) Coated | Impregnated (W/lb) Uncoated | Finished (W/lb) Coated | Finished (W/lb) Uncoated | % Improve-finished cores |
|---|---|---|---|---|---|---|---|
| 760 Square | 3.32 | | 9.97 | | 10.49 | | 33% |
| 760 Round | 3.48 | | 11.28 | | 11.3 | | |
| 770 Round | 4.63 | 4.54 | 10.5 | 16.42 | 10.7 | 16.18 | 34% |
| 780 Round | 7.52 | 5.74 | 11.84 | 17.51 | 11.36 | 18.19 | 38% |
| 800 Square | | 21.24 | | 20.56 | | 13.63 | 16% |
| 800 Round | 23.21 | 21.24 | 22.87 | 26.36 | 13.29 | 17.87 | |

The annealing conditions identified as "square" mean that a 75 amp DC current was passed through the window of the core, thereby creating a substantially longitudinal magnetic field for "square" magnetization curve annealing. The annealing conditions identified as "round" mean that no current was passed through the window of the core with no magnetic field present for annealing. The "no data" case for the finished 730° F. annealing condition resulted from a lost core. The indicated percent improvement for each annealing temperature range is an average of both the round and square loop condition, if both are present. There was an overall 30% improvement, considering the 690° F. to 800° F. range as a whole.

The apparent permeability of a core is strongly affected by the dimensions of the gap (if there is a gap) as follows: $1/\mu_{eff}=1/\mu_i+g/l_p$ where $\mu_{eff}$=effective or measured permeability of core; $\mu_i$=core material's intrinsic permeability under test conditions, i.e., flux level and frequency; g=total gaps, $l_p$=mean path length going in the direction of flux inside the core. Note that $\mu_{eff}=\mu_i$ when the gap is zero. Permeability is dimensionless in the cgs system discussed herein. This equation reduces to: $\mu_{eff}=\mu_i/(1+g/l_p\times\mu_i)$ where g and $l_p$ have the same dimensions. As an approximation: $\mu_{eff}\approx l_p/g$ when $g/l_p\times\mu_i>>1$.

Given this gap uncertainty, the CCFR instrument set used to measure permeability for uncut cores as reported above is inadequate for cut cores. Also the CCFR is not calibrated for a 20 kHz frequency, corresponding to the power loss test point of 2 kG and 20 kHz. To overcome these problems, a General Radio 1630-AV inductance measuring assembly was used to measure inductance for small coated "C" cores with carefully controlled gap dimensions. However there is an excitation difference between the CCFR and inductance bridge. The CCFR uses a sine wave for current, and the inductance bridge a sine wave for voltage, i.e., flux. This excitation difference between the two test sets will affect permeability comparisons. The bridge measures permeability to be somewhat larger than does the CCFR. However these differences are not believed to be large enough to affect the general nature of the conclusions resulting from these tests.

The following equation was used to calculate $\mu_i$ given the inductance and known gaps: $\mu_i=l_p/(4\times\pi\times10^{-9}\times N^2\times A_{eff}/L-g)$ where N=number of electrical turns; $A_{eff}$=effective area of core in square centimeters; L=inductance of core in henries; and $l_p$ and g (previously defined) are in centimeters. As mentioned earlier, $\mu_i$ has no unit dimensions in the cgs system used to report the data.

The equation was used to calculate $\mu_i$, for various gaps, including the mated surface gap. All permeability calculations were done at 2 kG and 20 kHz, using a 50 turn electrical coil symmetrically placed over both gaps to minimize fringing effects. The results are therefore comparable to core loss measurements done under the same conditions. The resultant calculated values of permeability were fitted to a straight line using regression techniques to estimate the material permeability as the "y" intercept, corresponding to zero gap. The accompanying power loss data was measured as described above. The following data shows the result for the 0.1 lb. "C" cores.

Table 11 compares the permeability and power loss of completed 0.1 lb. "C" cores, which were annealed and coated at 690° F. for four hours at the standard process condition for "square loop" requirements. The table compares the standard "square loop" with "round loop". The permeability estimates in Table 11 were obtained using a regression technique after cutting, applied to calculated permeability versus measured gap as described earlier. Permeability calculations were done for various gaps and fitted to a linear regression line, using standard formulas. The resultant regression line was extrapolated to zero gap to provide the permeability estimate for round and square loops (after cutting) shown in Table 11. Note that the permeability at the cut stage applies to the average of 5 cores for each group to improve the estimated accuracy.

Figure 20:
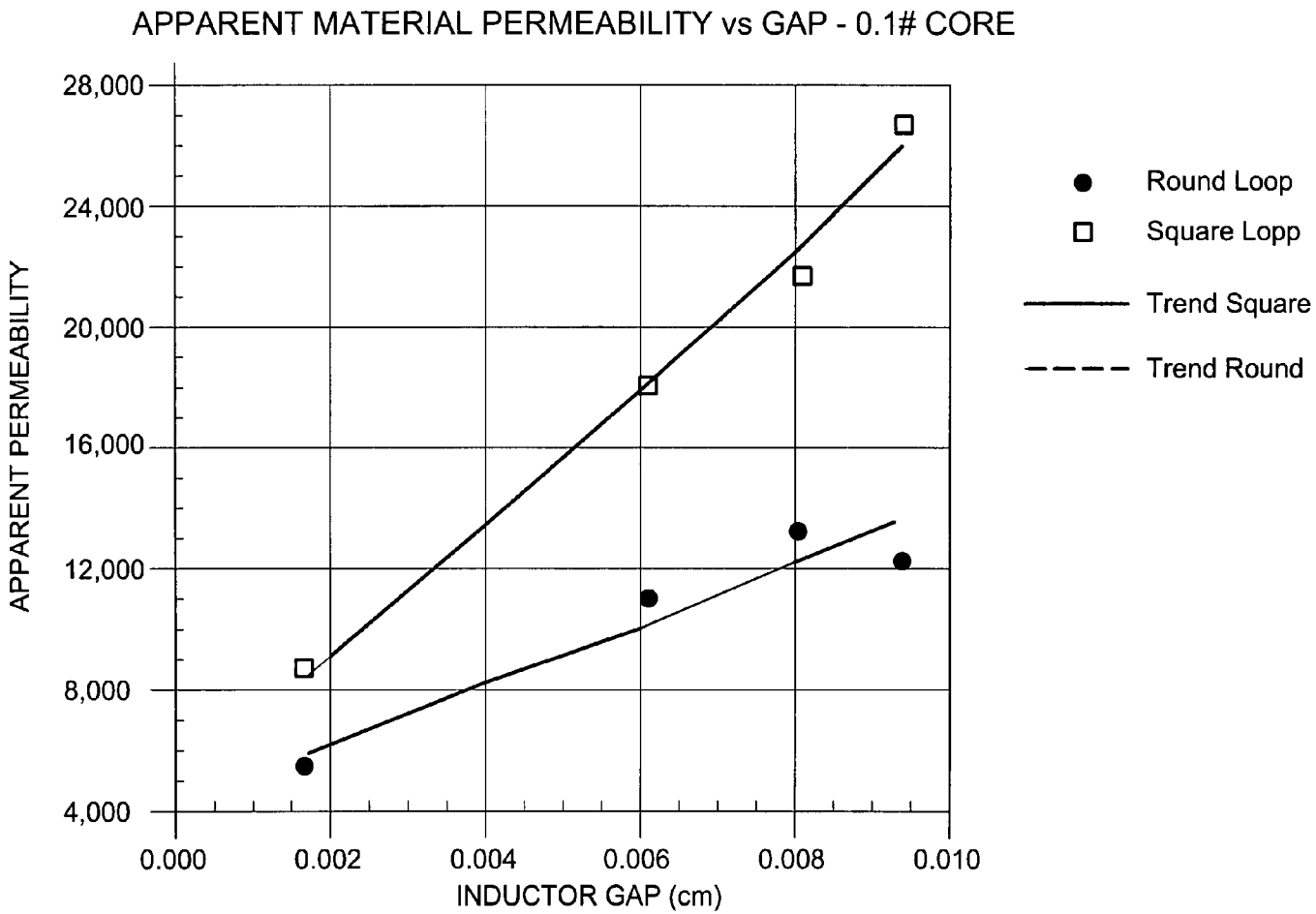
FIG. 20 is a plot of apparent permeability versus inductor gap in centimeters for regression analysis of the data of Table 12.
Figure 21:
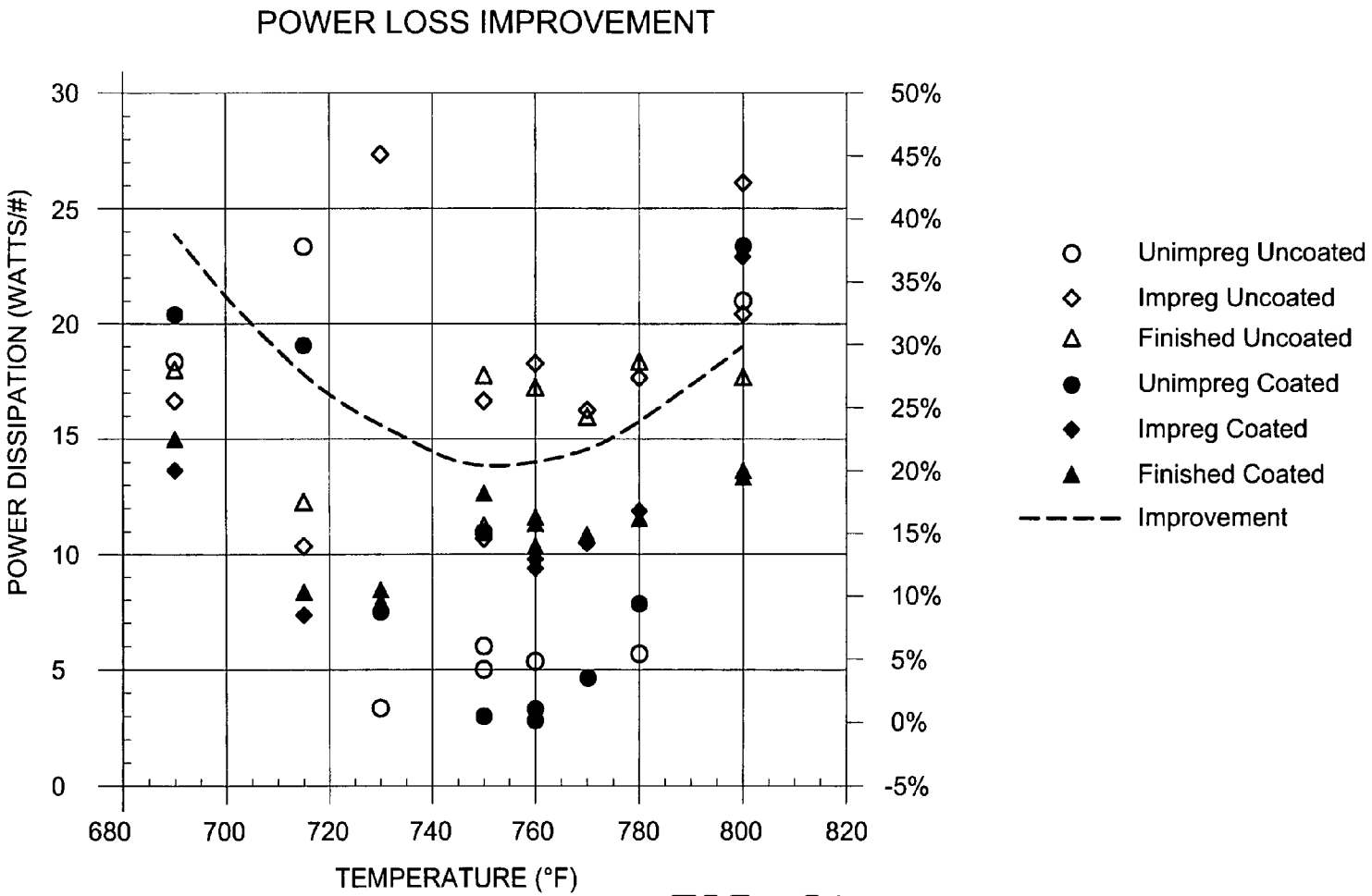
FIG. 21 and FIG. 22 are data plots of power loss improvements provided by the coating of the present invention at temperature ranges from about 680° F. to 800° F.
Figure 22:
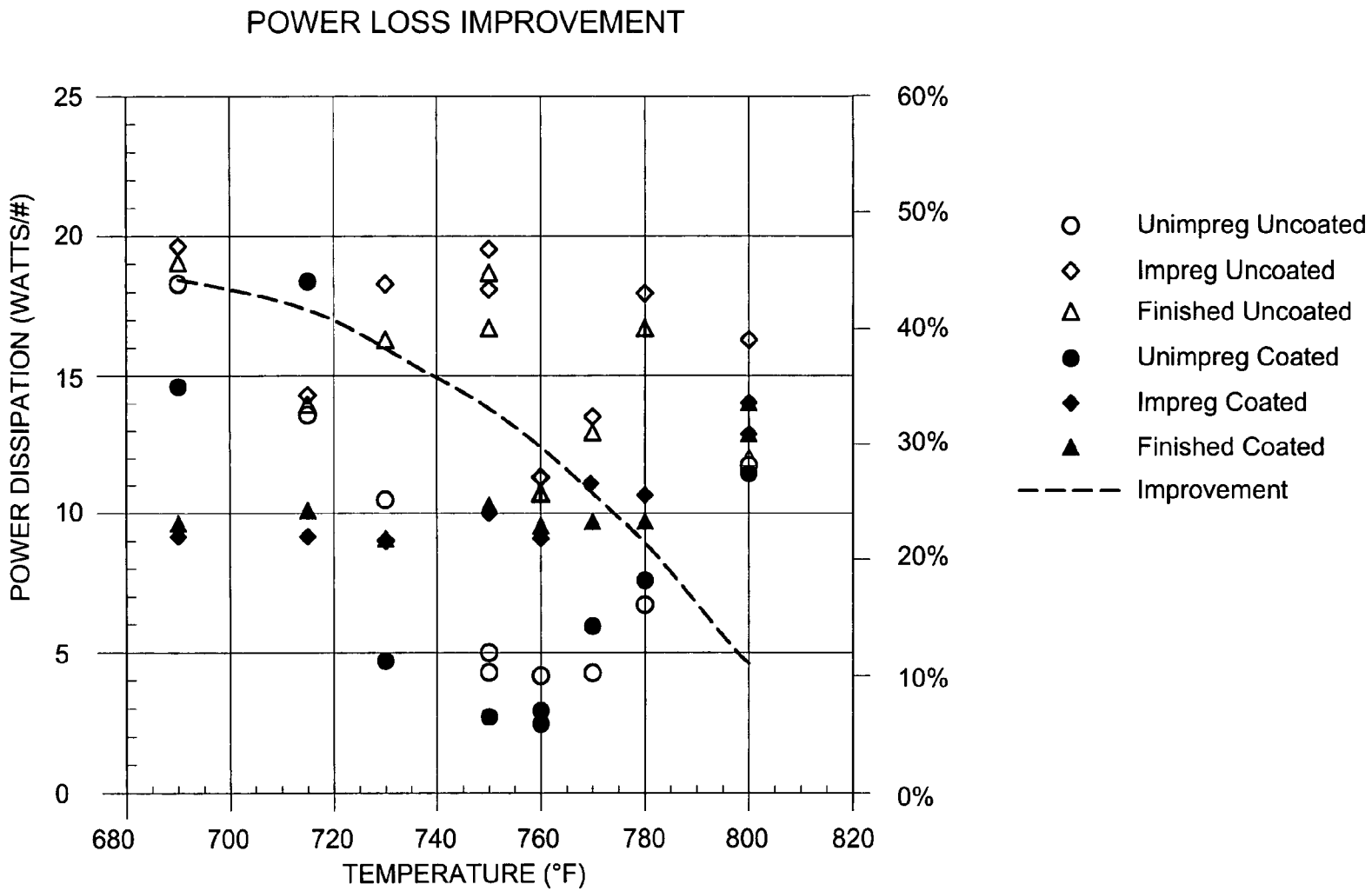

The gap measurements in Table 12 are rounded to 3 places. This level of accuracy is necessary so that the closeness of fit, calculated by the regression analysis, is reproducible. The gaps were actually checked to 0.0001" using an optical comparator. The resultant gap data was adjusted by the regression technique by no greater than this accuracy limit. The adjustment was done to achieve the best possible fit. FIG. 20 shows the resultant regression line and data corresponding to Table 12.

TABLE 11

Comparison of permeability and core loss before and after cutting - 0.1# core

| Condition | Permeability* | | Core loss (watts/#)* | |
|---|---|---|---|---|
| | Before cutting | After cutting | Before cutting | After cutting |
| Square loop | 5,142 ± 847 | 4,782 | 8.55 ± 1.20 | 8.91 ± 4.03 |
| Round loop | 4,914 ± 1,193 | 4,298 | 8.82 ± 0.81 | 9.13 ± 1.59 |

*Permeability (perm) and core loss data before cutting is taken after impregnation, and is the average of 10 cores for each condition. Perm data after cutting is at the finished core stage, and is the average of 5 cores for each condition. Perm data before cutting is taken at 400 Hz using a CCFR test set. Perm data after cutting is taken at 20 KHz using an inductance bridge. ± xxxx is 3 × σ (standard deviation). All cores areNAMLITE ® processed under standard 690° F. annealing conditions.

TABLE 12

Apparent material permeability after cutting - 0.1# core

| Measured gap (mils) | Adjusted gap (mils)* | Adjusted gap (cm)* | Round loop | Square loop |
|---|---|---|---|---|
| Projected to no gap | 0 | 0 | 4,298 | 4,782 |
| 0.65 (mating gap) | 0.65 | 0.00165 | 5,490 | 8,692 |
| 2.4 (amber shim) | 2.393 | 0.00608 | 10,823 | 18,339 |
| 3.2 (purple shim) | 3.173 | 0.00806 | 13,224 | 21,808 |
| 3.8 (red shim) | 3.702 | 0.00940 | 12,322 | 26,757 |

*Regression coefficients for round loop, square loop are 0.92 and 0.99, respectively. Projected no gap data is used for the permeability estimate at the "after cutting" stage in Table 1. Note that regression dither for the adjusted gap does not exceed the 0.1 mils, which is also the measurement error.

FIG. 20 reproduces Table 12 in graphical form with the regression overlay also shown. The calculated material permeability does not stay constant as the gap changes for two reasons. First, the calculation for material permeability is extremely sensitive to the gap dimension, as discussed earlier. Because it was impossible to measure the gaps to the required precision, the regression dither technique was used to adjust away as much of the gap uncertainty as possible. Second, the fringe flux tends to raise the inductance as the gap gets larger in proportion to the increase. This is a well documented effect, which inductor designers often need to take into consideration.

However the simple equation used to calculate the permeability in Table 12 does not take the complicated fringe flux effects into account. Since the effect of fringe flux is to increase inductance, it has the effect of also increasing the calculated material permeability as the gaps get larger. This is the primary reason why a regression analysis is needed, because it would otherwise not be possible to know the slope of the fringing error effect. The regression technique permits an estimate of the material permeability via a projection of the decreasing magnitude of the effect to zero gap, where it disappears.

Repeated Processing to Improve Performance

The improvement provided by the present inventive coating is primarily due to power loss reduction, which happens progressively. No coating results in no improvement. A thin coating results in marginally better power loss improvement over the "no coating" state, due to slight eddy current reduction. As the coating growth progresses, at first the additional improvement happens quickly due to the rapid increase in thickness of the coating. At this stage eddy currents diminish rapidly as the coating resistance increases with thickness. However, at some point the coating thickness increase slows down. When this happens the performance improvement also slows down, because the thickness is not increasing and eddy currents reach an equilibrium level. This is the normal "S" curve for growth processes which rely on the substrate. In this case the metal substrate provides iron to the coating as insulative iron oxides.

The crystallization effect is also time dependent, because of the "onset effect."Therefore if annealing is done long enough in the coating processing range, crystallization starts. Once crystallization starts, it is only a matter of time before resulting performance is adversely affected, i.e., permeability decreases, and coercive force and power loss increases.

Since coating growth and crystallization are both driven by temperature, when the temperature reduces to a certain level, probably below 500° F. to 600° F. or so, both processes slow down or stop. This "freezes" a given level of improvement into the coated product, permitting performance measurement for the frozen processing state. This assumes that crystallization has not started.

Therefore benefit first increases, then decreases with increased time and temperature, according to a complex relationship between these competing effects. For example, the coating may be applied progressively, by exposure to steam and heat for a first period of time, followed by cooling, and one or more subsequent steam/heat treatments. Measurements of permeability and power loss may be made between successive coating steps. At first there will be improvement, then degradation as the competing forces of eddy current reduction and crystallization work against each other. There is clearly a determinable safe range of time and temperature for given permeability and power loss requirements. Because the primary limiting factor is crystallization onset, the amount of processing time at any given temperature can be estimated from graphs in Wohlfarth, cited above. For example at 690° F. to 715° F., using graphs in chapter 6 of Wohlfarth, it can be estimated that approximately 10 to 15 hours of annealing are available before crystallization onset begins for METGLAS® 2605SA1. This allows 1 to 2 repeats of the normal processing condition of 5 hours to "creep up" on power loss reduction for square loop processing.

Consequently, if because of material variations, a first coating treatment does not produce a core having the desired properties, one or more additional processing times may sometimes be used to improve performance of the coated cores to the desired level. Of course, as noted above, each additional process should be within the limits of the material so that crystallization effects do no outweigh the benefits of the additional processing. The measurement and repeated processing must happen before impregnation.

The following table shows how this reduces to practice. The data was taken on a 40 lb. toroid, built from METGLAS® 2605SA1, designed to be used in a very high power transformer assembly. The data reports stack resistance improvements as a result of a first coating at 690° F. for six hours, followed by cooling and resistance measurement, then a second coating processing at 290° F. for 6 hours, or a total of 12 hours including the original processing time. Increasing stack resistance is generally related to improved performance for strip cores.

TABLE 13

Comparison of DC stack resistance for 40 lb. METGLAS ® 2605SA1 toroids

| Core no. | 1st - 6 hr coating process stack (Ω) | 2nd - 6 hr coating (12 hours total) process stack (Ω) | |
|---|---|---|---|
| 24 | 314 | 880 | +180% |
| 26 | 267 | 347 | +30% |
| 29 | 295 | 841 | +185% |
| 30 | 130 | 546 | +320% |
| 31 | 356 | 836 | +135% |
| 32 | 1,456 | 1,295 | −11% |
| 33 | 814 | 1,603 | +97% |
| 34 | 965 | 2,031 | +110% |
| 35 | 869 | 1,485 | +71% |
| 36 | 996 | 2,192 | +120% |
| 38 | 769 | 1,596 | +108% |
| 39 | 715 | 1,704 | +138% |
| 40 | 915 | 2,645 | +189% |
| 41 | 534 | 2,095 | +292% |
| 42 | 721 | 2,218 | +208% |
| 43 | 530 | 685 | +29% |
| 44 | 1,200 | 1,490 | +24% |
| 45 | 1,238 | 1,413 | +14% |
| Avg change | | +124% net avg. improvement | |

The 124% net average improvement is substantial. Only 1 part in the 18 reprocessed shower a slight degradation, i.e., −11%.

EXAMPLES

The Examples which follow are illustrative of the ease of the process of the present invention, and the superior performance properties which result in cores produced by the present inventive process.

For the following Examples, power dissipation in C cores was measured by connecting a Volt-Amps-Watts (V-A-W) meter (Clark Hess Digital, New York, N.Y.) and a 2 MHz function generator (Maxtec International Corp, Chicago, Ill., model BK Precision 3011B) to a kilowatt amplifier (Model L6, Instruments, Inc., San Diego, Calif.) to control the output, shape and amplitude frequency and to measure the same. Sine waves with variable amplitude and frequency were then applied to the C cores through one of two possible multi-turn coils. The coils were wrapped around the C cores and connected to the output junctions of the kilowatt amplifier. Typical measurement conditions applied to the cores were dependent on the desired flux, and representative examples appear in Table 14.

TABLE 14

Electrical setup conditions for "C" core power measurement

| Frequency (kHz) | Excitation voltage (volts) | Required flux level (kG) | Required number of turns (T) |
|---|---|---|---|
| 0.4 | 14.6 | 2.0 | 50T |
| 0.4 | 36.6 | 5.0 | 50T |

TABLE 14-continued

Electrical setup conditions for "C" core power measurement

| Frequency (kHz) | Excitation voltage (volts) | Required flux level (kG) | Required number of turns (T) |
|---|---|---|---|
| 0.4 | 72.6 | 10.0 | 50T |
| 0.4 | 109 | 15 | 50T |
| 1.0 | 3.6 | 2.0 | 5T with step down transformerr |
| 1.0 | 9.26 | 5.0 | 5T with step down transformerr |
| 10.0 | 36.6 | 2.0 | 5T |
| 20.0 | 73 | 2.0 | 5T |

*The above combinations are not unique. They were chosen to arrive at the selected flux level.

These levels were set using the Precision function generator by using the readout of the function generator, and the voltage reading display setting of the V-A-W meter. The V-A-W meter directly measures the core power loss and excitation current, using the power measurement and current measurement settings.

To measure the power dissipation of pulsed toroids, a pulse generator (Hewlett Packard Model 214A), a high power pulse generator (Model 606, Cober Electronics, Stamford, CT) and a regulated power supply (model 814A, Harrison Laboratories, Berkley Heights, NJ) were connected to a vacuum tube pulser to control its output rise time, duty cycle and amplitude for repetitive pulsing conditions. The vacuum tube pulser was connected to a 3 to 6 turn coil of high amperage cable, which was wrapped around the toroid being studied. The setup is isolated because of the high voltages being generated. An oscilloscope (Philips Model PM3323 500MS/s with 30 kV probe) was used to record the pulse shape, the core excitation profile and the integrated power response in memory. Typical measurement ranges were 1.5 to 3.0 microseconds for the pulse width, 15 to 20 ampere turns on the DC reset, with the pulser adjusted to achieve 1 to 4 tesla of flux in the core. The pulse testing apparatus is illustrated schematically in FIG. 6.

Example 1

Decreased Power Losses

Wound cores of amorphous metal alloys such as METGLAS® 2605SA1 having approximately greater than 70% iron were simultaneously annealed and then treated with steam (pH 8) and air at 365° C. (690° F.) for 6 hours to form an iron metal oxide insulating material between the adjacent metal ribbon layers of the cores. Two groups of cores were formed. The first group consisted of cores weighing approximately 5 lb. each and the second group consisted of cores weighing approximately 1 lb. each. Power loss data was normalized between the two groups by dividing the power loss by the weight of the core.

A second set of cores consisting of the two groups was made as above, but was not subjected to the steam and air treatment as described above. Consequently, this set of cores lacked the iron oxide insulating layer, and was used as a baseline to compare the power loss performance of the treated cores. The normalized data is shown below in Table 15.

TABLE 15

Comparison of power loss of treated and untreated amorphous iron cores as a function of frequency
Power loss (watts/lb) for treated and untreated iron cores

| Frequency (kHz) | Untreated | Treated | % Improvement |
|---|---|---|---|
| 0.4 | 1.9 | 1.3 | 14 |
| 1.0 | 3.9 | 2.7 | 17 |
| 10.0 | 13 | 9.9 | 30 |
| 16.0 | 27 | 19 | 33 |
| 20.0 | 17 | 9.0 | 45 |

The data of Table 15 demonstrates that treating wound cores containing amorphous iron alloy with the method of the present invention generates cores that perform 14% to 45% better than untreated cores at high frequencies. Namely, power losses in the treated cones are decreased by from 14% to 45%. Further, the improvement in performance increases as the frequency increases, as shown above.

The cores were then either coated with magnesium methylate prior to winding, or treated with steam/air after winding to form an iron oxide insulating layer, or both, as described below in Table 16.

The cores were tested by applying about 8.6 kV using very low frequency duty cycle, 5 turn primary (prim), 10 pps and the pulse energy calculated from the 3 μsec pulse width with a 2.85 T flux swing. The pulse data measurements included core power (the amount of power dissipated by the core), starting current, and saturation current. Pulse energy was then calculated from the area under the pulse curve multiplied by the voltage to give the joules of power. In all of the measurements, the lower the number, the better the core. Further, it is favorable for the starting current be as close to the saturation current as possible. Test results are shown in Table 6.

TABLE 16

Pulse core data for cores treated with magnesium methylate and steam/air

| Test | Process | Core power (kW) | Starting current (amperes) | Saturation current (amperes) | Pulse energy (joules) |
|---|---|---|---|---|---|
| 1 | Oil impregnation, methylate, steam/air | 201 | 20 | 38 | 0.75 |
| 2 | Methylate, steam/air | 204 | 20 | 40 | 0.77 |
| 3 | Light resin impregnation, steam/air | 287 | 30 | 50 | 1.0 |
| 4 | Heavy resin impregnation, steam/air | 331 | 30 | 60 | 1.2 |
| 5 | Oil impregnation, steam/air | 196 | 22 | 32 | 0.7 |
| 6 | Magnesium methylate | 200 | 20 | 40 | 0.8 |

A similar experiment was performed with cores formed of nanocrystalline materials, such as 70% Fe, 9% B, 3% Nb, 2% Cu and small amounts of Mo, Co and S. These cores were annealed at about 538° C. (1000° F.), cooled to room temperature, and then treated to form the iron oxide insulating layer as described above. The observed decrease in power losses for these cores in comparison to untreated nanocrystalline cores was similar to that observed for the amorphous metal alloy cores of Table 15.

Example 2

Comparison of Cores Treated with Steam and Air with Cores Treated with Magnesium Methylate in Pulse Tests Magnetic cores were formed from about 1 mil thick amorphous iron ribbon, such as METGLAS® 2605SA1, as toroidal pulse cores with 19.7 cm (7.75") outside diameter, 10.8 cm (4.25") inside diameter, and a 51.1 cm (2") width.

All of the cores shown in Table 16 were amorphous metal alloys containing iron as the dominant metal. For the core of Test 1, the amorphous metal ribbon was coated with a very thin coat of magnesium methylate, the ribbon was formed into a laminate core, and steam and air were applied by first annealing the cores at about 366° C. (690° F.) for two hours then treating with steam (approximately pH 8) and air at 304° C. to 316° C. (580° F. to 600° F.) for approximately 6 hours, to also from an iron oxide insulating layer. The core was then impregnated with oil. Cores vibrate during the pulse tests, and the oil was added to help protect the core during the test. For the core of Test 2, the ribbon was coated with a very thin film of magnesium methylate, coiled into a laminate core, and the core was treated with steam/air as described in Example 1. The core of Test 3 was formed by coiling an amorphous metal ribbon into a laminate core and treating the core with steam and air as in Example 1. The treated core was then impregnated with a light resin. The core of Test 4 was formed in the same manner as the core of Test 3 and was then impregnated with a heavy resin. The core of Test 5 was formed by coiling an amorphous metal ribbon into a laminate core and then treating the core with steam and air as in Example 1. The core was then impregnated with oil, similar to the core of Test 1. The core of Test 6 was formed by coating an amorphous metal ribbon with a very thin layer of magnesium methylate and coiling the ribbon into a laminate core.

As shown above, the cores which were treated with steam and air to form iron oxide insulating layers generally performed as well or better in the pulse tests as the cores which were formed from ribbon coated with magnesium methylate. However, the insulating layers produced with the steam/air were made much faster and with far less expense than coating with thin layers of magnesium methylate.

Further, pulse cores coated only with magnesium methylate and then impregnated with resin broke apart during testing, and are not shown in Table 16 for that reason. Consequently, as the data demonstrates, there is more flexibility in the treatments that can be done with the pulse cores with insulating layers formed of native metal oxides such as iron oxide than with the pulse cores formed with magnesium methylate coatings. Coating the cores with resin, as in Tests 3 and 4, simulates the binding agent processing that would be done prior to cutting the core to form a "C" core, for example. Even though the core power losses of the resin-impregnated cores prepared from cores which were previously treated with steam/air were 40% to 50% higher than the comparable cores which were not impregnated with resin, the benefits of impregnation may outweigh the increase in power dissipation in some applications where the increased rigidity is important.

Example 3

Performance vs. Processing Temperature

The following Table 17 shows the performance effects of processing amorphous metal cores having iron as the dominant metal under different temperature conditions. The cores used were all approximately five pounds in weight, with an approximate 5.1 cm (2") wide strip width. All cores were treated with steam in the presence of air for 4 hours and annealed for 2 hours, except for the core simultaneously annealed and processed. The latter was annealed and steam treated simultaneously for 4 hours. An identical set of cores were created and annealed, but were not exposed to steam/air to form the iron oxide insulating coat. The power losses of each set of cores were measured, and are compared below.

TABLE 17

Relative performance of iron oxides coated on "C" cores compared to same uncoated configurations

| Processing conditions | Frequency (kHz) 0.4 | 1.0 | 10.0 | 20.0 |
|---|---|---|---|---|
| 500° F. processing & 690° F. annealing | 9.0% | 43.9% | 21.1% | 19.8% |
| 550° F. processing & 690° F. annealing | −19.5% | 12.9% | −71.5% | −77.0% |
| 590° F. processing & 690° F. annealing | −5.7% | 22.2% | −53.1% | −57.3% |
| 625° F. processing & 690° F. annealing | −1.0% | 38.1% | 18.2% | 17.8% |
| 650° F. processing & 690° F. annealing | −4.3% | 31.2% | −12.7% | −18.5% |
| 690° F. simultaneous processing & annealing | 22.8% | 52.2% | 50.2% | 52.7% |

Note:

Core losses expressed as percentage improvement (reduction) compared to comparable uncoated configuration.

Figure 5:
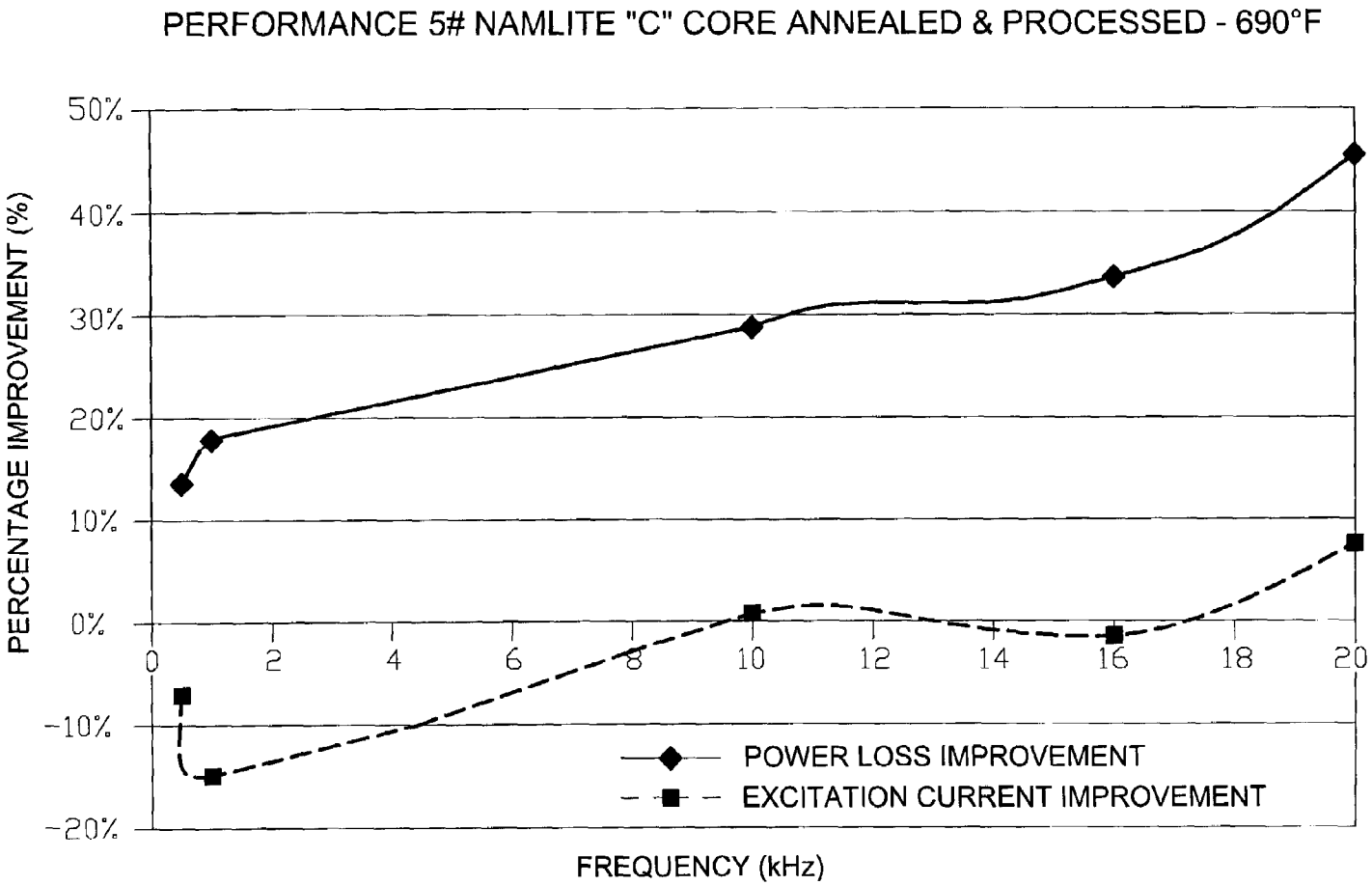
FIG. 5 is a comparative graph of the improved performance of coatings applied using steam generated from feedwater with a basic pH.

Table 17 reflects data taken from cores processed using pH enhanced steam, approximately pH 8 to 10, from a steam generator using feedwater from a reverse osmosis system. For comparison purposes. FIG. 5 (Table 15) shows the same core configuration processed from unpurified tap water as the feedwater having a pH of about 8.

Example 4

Shown below in Table 18 are comparisons of uncut toroidal cores of various weights. The cores were formed from amorphous metal alloys such as METGLAS® 2605SA1. Iron is the dominant elemental metal. The cores were annealed at about 366° C. (690° F.) for 2 hours, and then treated with steam/air at about 304° C. to 316° C. (580° F. to 600° F.) for 2 to 6 hours. As can be seen from Table 18, cores having the insulative coatings of the present invention exhibited significantly decreased power losses for the higher 20 kHz frequency.

TABLE 18

Comparison of power losses uncut core configurations with/without steam/air

| Part | Low frequency - 400 Hz | | High Frequency - 20 kHz | | | |
|---|---|---|---|---|---|---|
| Weight (lbs) | Untreated (watts/#) | Treated (watts/#) | Untreated (watts/#) | Treated (watts/#) | 400 Hz Impendance | 20 kHz Impedance |
| 0.83 | 2.2 | 2.9 | | | −31% | |
| 0.92 | 1.8 | 2.2 | 13 | 7.2 | −19% | 46% |
| 1.24 | 1.4 | 2.0 | | | −41% | |
| 2.68 | | | 29 | 5.8 | | 80% |

TABLE 18-continued

Comparison of power losses uncut core configurations with/without steam/air

| Part | Low frequency - 400 Hz | | High Frequency - 20 kHz | | | |
|---|---|---|---|---|---|---|
| 5.95 | 1.9 | 2.2 | 58 | 18 | −21% | 69% |
| 7.24 | 1.4 | 2.0 | 13 | 10 | −44% | 23% |

Example 5

METGLAS® 2605SA1 cores were annealed for two hours at 690° F., and then steam/air treated at about 304° C. to 316° C. (580° F. to 600° F.) for 2, 4 or 6 hours. As shown below in Table 19, observed power losses generally decrease as the steam/air treatment time increases from 2 hours to 6 hours.

TABLE 19

Power dissipation (watts/#) at two frequencies versus processing time

| # | Processing Time (min) | Dissipation - 400 Hz | Dissipation - 20 kHz |
|---|---|---|---|
| 1 | 120 | 1.9 | 18 |
| 2 | 120 | 1.6 | 17 |
| 3 | 120 | 1.5 | 16 |
| 4 | 120 | 1.5 | 12 |
| 5 | 120 | 2.1 | 22 |
| 6 | 120 | 1.9 | 19 |
| 7 | 120 | 3.0 | 12 |
| 8 | 120 | 2.2 | 20 |
| 9 | 240 | 1.3 | 15 |
| 10 | 240 | 1.5 | 13 |
| 11 | 240 | 1.6 | 17 |
| 12 | 360 | | 10 |
| 13 | 360 | | 17 |

Note:
Results reflect normalized data of various core configurations with weights varying from slightly under 1 pound to slightly over 7 pounds.

Although the present invention and its advantages have been described in detail by referring to specific embodiments, it should be understood that various changes, substitutions and alterations can be made to such embodiments, as is know to those of skill in the art, without departing from the spirit and scope of the invention which is defined by the following claims.

The invention claimed is:

1. A method of providing an iron oxide coating to a laminated magnetic assembly which is formed in part of iron, comprising:

providing a ferric oxide ($F_2O_3$) source;

injecting steam through the ferric oxide source, such that the steam becomes infused with ferric oxide cations;

injecting the infused steam into a heated chamber housing the laminated magnetic assembly; and oxidizing the iron of the laminated magnetic assembly in the presence of the steam, the heat and the ferric oxide cations.

2. The method of claim 1, further comprising exposing the laminated magnetic assembly to at least its annealing temperature for a time period of at least 2 hours.

3. The method of claim 1, further comprising exposing the laminated magnetic assembly to at least its annealing temperature for a time period of at least 4 hours.

4. The method of claim 1, further comprising exposing the laminated magnetic assembly to at least its annealing temperature for a time period of at least 6 hours.

5. The method of claim 1, further comprising exposing the laminated magnetic assembly to at least its crystallization onset temperature for a time period of at least 2 hours.

6. The method of claim 1, further comprising exposing the laminated magnetic assembly to at least its crystallization onset temperature for a time period of at least 4 hours.

7. A method of providing an iron oxide coating to a laminated magnetic assembly which is formed in part of iron, comprising:

providing a source of $[Fe_xO_y]^{+z}$ cations in a transference matrix where $1 \leqq x \leqq 2$, $1 \leqq y \leqq 3$ and $1 \leqq z \leqq 3$;

injecting steam through the transference matrix, such that the steam becomes infused with ferric oxide cations;

injecting the infused steam into a heated chamber housing the laminated magnetic assembly; and oxidizing the iron of the laminated magnetic assembly in the presence of the steam, the heat and the ferric oxide cations.

8. The method of claim 7, further comprising exposing the laminated magnetic assembly to at least its annealing temperature for a time period of at least 2 hours.

9. The method of claim 7, further comprising exposing the laminated magnetic assembly to at least its annealing temperature for a time period of at least 4 hours.

10. The method of claim 7, further comprising exposing the laminated magnetic assembly to at least its annealing temperature for a time period of at least 6 hours.

11. The method of claim 7, further comprising exposing the laminated magnetic assembly to at least its crystallization onset temperature for a time period of at least 2 hours.

12. The method of claim 7, further comprising exposing the laminated magnetic assembly to at least its crystallization onset temperature for a time period of at least 4 hours.

13. The method of claim 7 further comprising the step of forming the transference matrix by soaking aluminum silicate in a dilute ferric chloride solution, the dilute ferric chloride solution clarified with hydrogen chloride, reducing the mixture with ammonium hydroxide, and heating the mixture to adsorb the produced ferric oxides.

* * * * *